US010535969B2

(12) United States Patent
Sutter

(10) Patent No.: US 10,535,969 B2
(45) Date of Patent: Jan. 14, 2020

(54) CRIMP TOOL HAVING A RECEPTACLE ELEMENT FOR RECEIVING AN ELECTRICAL CONNECTOR

(71) Applicant: IDEAL Industries, Inc., Sycamore, IL (US)

(72) Inventor: Robert W. Sutter, DeKalb, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 280 days.

(21) Appl. No.: 15/397,874

(22) Filed: Jan. 4, 2017

(65) Prior Publication Data

US 2017/0338614 A1 Nov. 23, 2017

Related U.S. Application Data

(60) Provisional application No. 62/276,656, filed on Jan. 8, 2016, provisional application No. 62/416,976, filed on Nov. 3, 2016.

(51) Int. Cl.

| | |
|---|---|
| ***H01R 43/042*** | (2006.01) |
| ***H01R 43/01*** | (2006.01) |
| ***H01R 24/64*** | (2011.01) |

(52) U.S. Cl.

CPC ..... *H01R 43/042* (2013.01); *H01R 43/015* (2013.01); *H01R 24/64* (2013.01); *H01R 43/0421* (2013.01)

(58) Field of Classification Search

CPC .... H01R 24/64; H01R 43/015; H01R 43/042; H01R 43/0421

See application file for complete search history.

(56) References Cited

U.S. PATENT DOCUMENTS

| | | | | |
|---|---|---|---|---|
| 5,042,286 | A * | 8/1991 | Wiebe | B25B 7/12 29/751 |
| 6,732,393 | B1 * | 5/2004 | Liao | B26B 11/00 29/751 |
| 7,103,968 | B2 * | 9/2006 | Karrasch | H01R 43/015 29/564.4 |
| 7,299,542 | B2 * | 11/2007 | Montena | H01R 43/042 29/748 |
| 7,703,196 | B2 * | 4/2010 | Chawgo | H01R 43/0425 29/751 |
| 8,015,698 | B2 * | 9/2011 | Sutter | H01R 9/05 29/751 |
| 2006/0032048 | A1 * | 2/2006 | Liao | H01R 43/042 29/750 |
| 2017/0338614 | A1 * | 11/2017 | Sutter | H01R 43/042 |

* cited by examiner

*Primary Examiner* — Minh N Trinh

(74) *Attorney, Agent, or Firm* — Greenberg Traurig, LLP

(57) ABSTRACT

A crimping tool for an electrical connector includes a frame defining an interior, a handle rotatably coupled with the frame, and a receptacle disposed within the interior of the frame and configured in size and shape to receive an electrical connector. The crimping tool further includes a push member, coupled with the handle, configured to apply a compressive force to an electrical connector disposed within the receptacle responsive to actuation of the handle relative to the frame and a blade coupled to the frame, to the receptacle, or to the push member, so as to be actuatable to cut excess wiring from an electrical connector disposed within the receptacle.

8 Claims, 26 Drawing Sheets

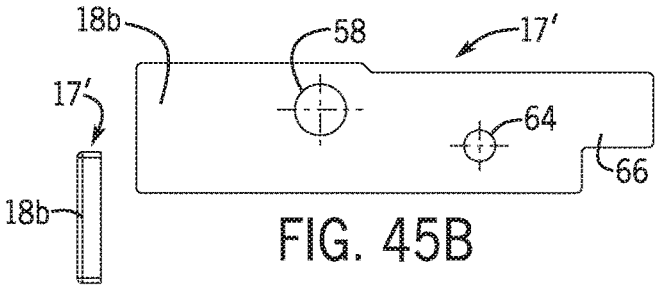
FIG. 45A
FIG. 45B
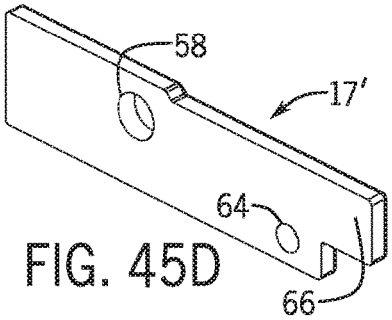
FIG. 45D
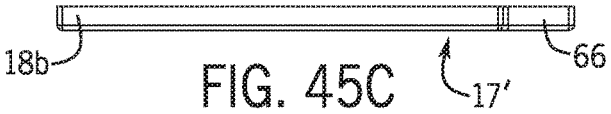
FIG. 45C
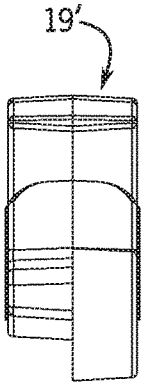
FIG. 46A
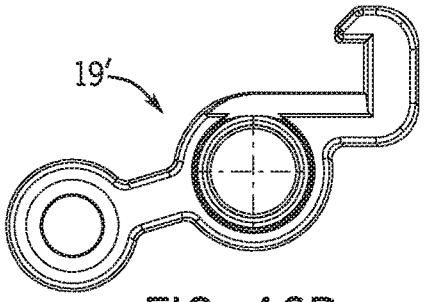
FIG. 46B
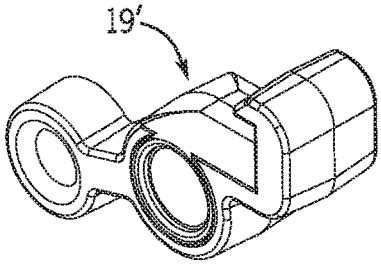
FIG. 46D
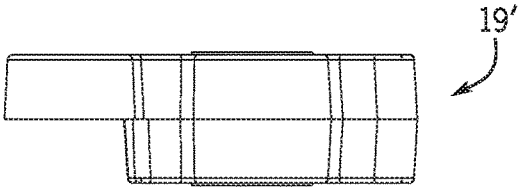
FIG. 46C

CRIMP TOOL HAVING A RECEPTACLE ELEMENT FOR RECEIVING AN ELECTRICAL CONNECTOR

CROSS REFERENCE TO RELATED APPLICATION

This application is a non-provisional application claiming priority from U.S. Provisional Application Ser. No. 62/276,656, filed Jan. 8, 2016, and U.S. Provisional Application Ser. No. 62/416,976, filed Nov. 3, 2016, each of which are incorporated herein by reference in their entirety.

FIELD OF THE DISCLOSURE

The instant disclosure relates to tools for the assembly of electrical connectors, including crimping tools for modular electrical connectors, and methods for assembling such tools.

BACKGROUND OF RELATED ART

Modular electrical connectors are generally used for connection of signal-carrying cables, such as data and voice cables, with systems and devices, such as telephone and computer systems and devices and their supporting networks. Over time, modular electrical connectors for such cables may degrade or break due to repeated or improper usage. Accordingly, connectors may need to be replaced. In addition, modular electrical connectors may be used to assemble such cables in the first instance.

To replace an electrical connector, such as for instance an RJ-45 connector, on a cable, a user generally must cut off the existing connector, strip the cable sheath to access the electrically-conductive wires, insert the wiring into a new connector, and rigidly couple the electrically-conductive portion of the wiring with electrical contacts of the new connector. In general, the connection between the connector and the wiring is preformed via insulation displacement connection. Furthermore, in some instances, the wires must be cut to length prior to insertion into the new connector, while in other instances; the wires may be left "long", inserted through the connector, and trimmed to length during the crimping/connection process itself.

While known connection tools and processes may be generally satisfactory, there is an identifiable need for an improved crimp tool for modular electrical connectors and methods of assembling same.

BRIEF DESCRIPTION OF THE DRAWINGS

FIGS. 45A-45D illustrate an example strain relief pusher 17' of the tool of FIG. 27.

FIGS. 46A-46D illustrate an example push rod retainer 18' of the tool of FIG. 27.

DETAILED DESCRIPTION

Figure 1:
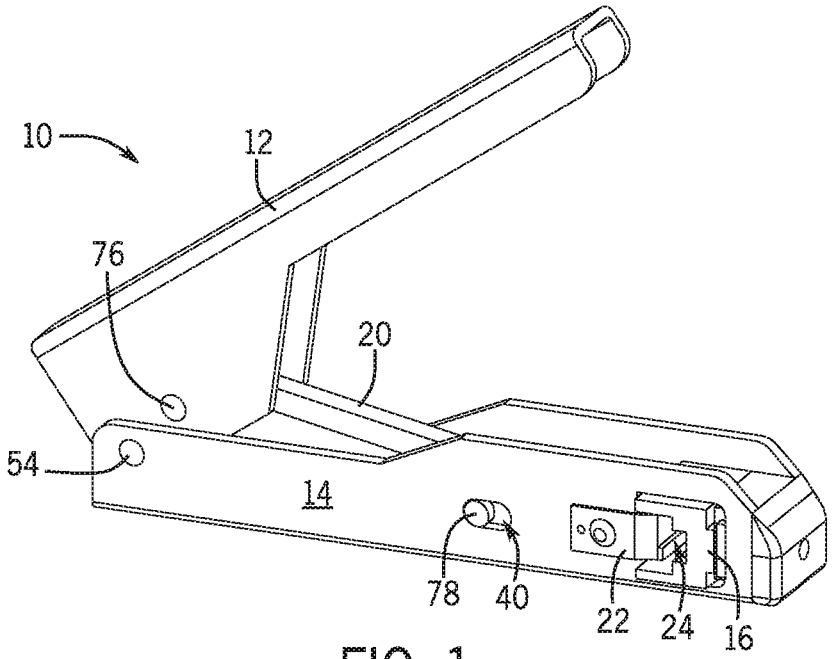
FIG. 1 is an isometric view of an example modular connector crimp tool.
Figure 2:
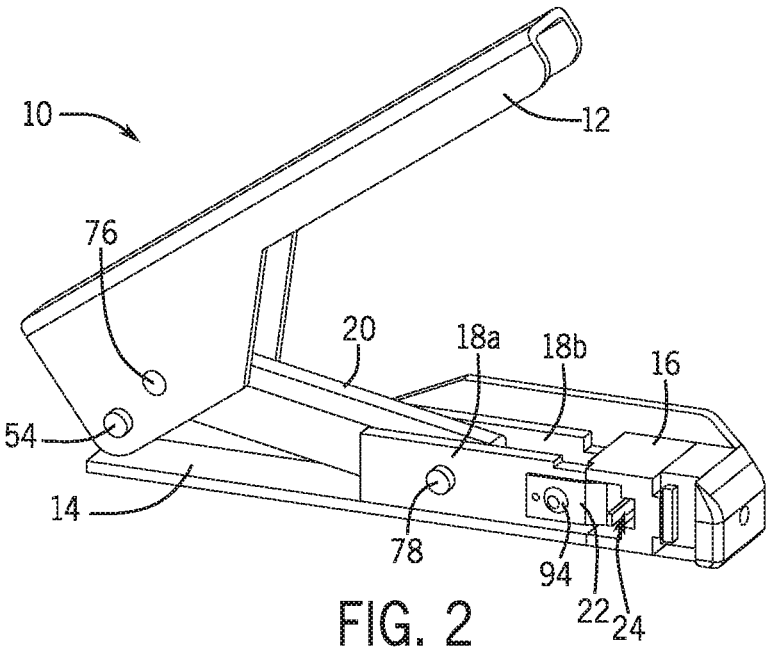
FIG. 2 is an isometric view of the example modular connector crimp tool of FIG. 1, with portions cut away to illustrate the interior of the tool.
Figure 3A:
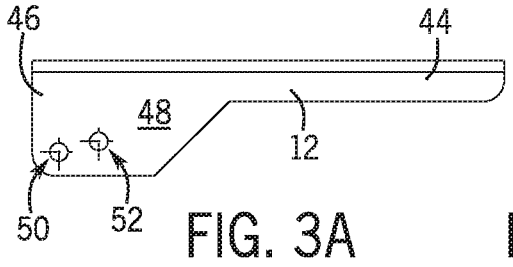
FIGS. 3A-3D are various views of an example handle of the example modular connector crimp tool of FIG. 1.
Figure 3C:
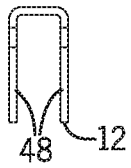
Figure 3D:
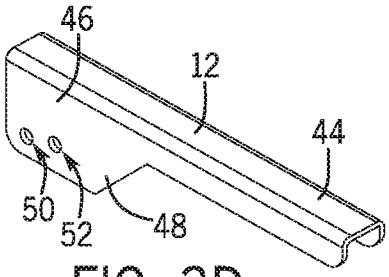
Figure 3B:
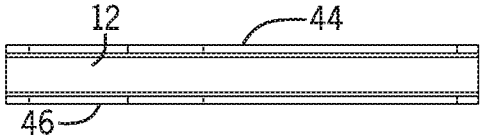

Referring now to the figures, wherein like reference numerals refer to the same or similar features and elements in the various views, FIG. 1 is an isometric view of an example modular connector crimp tool 10 (which may be referred to simply as "the tool 10" or "the example tool 10" in this disclosure for ease of description), and FIG. 2 is an isometric view of the example tool 10. The example tool includes a handle 12, a frame 14, a receptacle 16, two push members 18*a*, 18*b*, a push rod 20, and a blade 22, among other components that will be set forth in this disclosure. The tool 10 may be used to rigidly couple the electrically-conductive portion of a cable with the electrical contacts of an electrical connector, such as a modular electrical connector.

The receptacle 16 is configured in size and shape to receive an electrical connector, such as a connector for a data cable (e.g., a CAT3, CAT5e, or CAT6 cable) or a voice cable. For example, the electrical connector may be an RJ-45 or RJ-11 modular connector. The tool 10 may be used to crimp and/or otherwise couple electrical wires within such a connector so as to reliably electrically couple those wires with the electrical contacts of the connector, in an example. Accordingly, the example tool 10 is configured to crimp the connector with electrical wiring of a cable disposed within the connector. Of course, the tool 10 may also find use with other connectors and other electrical wiring and cable types.

For clarity of illustration, not all elements are designated in every figure in which they appear. For example, specific features of the components of the tool 10 (e.g., features of the handle 12, of the frame 14, and so on) may not be designated in FIG. 1 or 2, but may be designated only in the further figures which illustrate those components in isolation and in detail.

Referring to FIGS. 1, 2, and 8A-8D, the example receptacle 16 defines a cavity 24 configured to receive a connector. The cavity 24 is accessible through a first opening 26 and a second opening 28 (labeled in FIG. 8D). A connector may be inserted into the cavity 24 of the example receptacle 16 through the first opening 26. The example receptacle 16 further includes two protrusions 30 that prevent a connector from exiting the receptacle cavity 24 through the second opening 28. The protrusions 30 are also configured to align the end of the connector with the path of the blade 22 so as to allow the blade 22 to cut excess wiring from the connector. It will be appreciated that in some instances, the connector may contact the protrusions 30 and/or the blade 22 (if present) to prevent the connector from exiting the receptacle cavity 24.

Referring to FIGS. 1, 2, and 15A-15D, an example frame 14 includes a base 32 and two parallel sidewalls 34 that extend perpendicularly from the base 32. The base 32 and sidewalls 34 collectively define an interior 36 of the frame. The sidewalls 34 may include a plurality of openings and apertures, such as openings 38 to receive the receptacle 16, guide openings 40, and handle pivot pin apertures 42. In the example tool 10, when assembled, the receptacle 16 is disposed within the interior 36 of the frame 14, as shown in FIGS. 1 and 2.

Figure 16A:
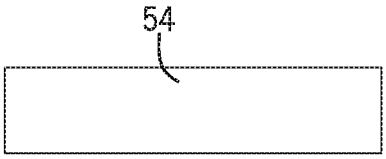
FIGS. 16A-16C are various views of an example handle pivot pin of the example modular connector crimp tool of FIG. 1.
Figure 16B:
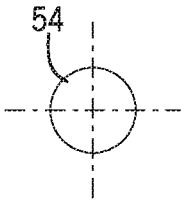
Figure 16C:
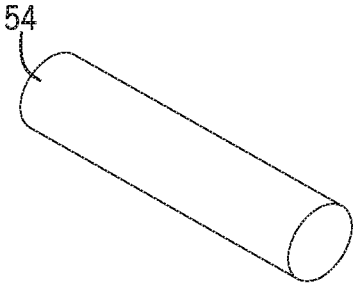

Referring to FIGS. 1, 2, and 3A-3D, an example handle 12 includes a grip portion 44 and a base portion 46. The grip portion 44 is configured in size and shape to be gripped by a user so as to actuate the handle 12 to operate the tool 10. The base portion 46 of the example handle 10 includes two parallel sidewalls 48. The sidewalls 48 include complementary apertures, including handle pivot pin apertures 50 and push rod pin apertures 52. In the example tool, as shown in FIGS. 1 and 2, the handle 12 is hingedly and rotatably coupled to the frame 14 with a handle pivot pin 54 (shown in detail in FIGS. 16A-16C) that extends through the handle pivot pin apertures 50 of the handle base portion 46 and the handle pivot pin apertures 42 of the frame sidewalls 34.

Referring to FIGS. 1, 2, 6A-6D, and 7A-7D, push members 18*a*, 18*b* are disposed within the interior 36 of the frame 14 and are arranged so as to apply compressive force on a connector disposed within the cavity 24 of the receptacle 16 responsive to actuation of the handle 12 (i.e., in the example tool 10, responsive to rotation of the handle 12 about the handle pivot pin 54). In the example tool 10, the push members 18*a*, 18*b* are disposed parallel to each other and parallel to the sidewalls 34 of the frame 14.

The example push members 18*a*, 18*b* are configured for applying compressive forces to different portions of the connector, in the example tool 10. Referring to FIGS. 6A-6D, an example first push member 18*a* is configured to compress an electrical contact portion of the connector, and thus may be referred to herein as a contact push member 18*a*. The contact push member 18*a* includes a ridged compression edge 56 configured to crimp the electrical contact portion of a connector so as to reliably couple electrical wires with the electrical contacts of the connector. The contact push member 18*a* further includes a guide pin aperture 58, a blade screw aperture 60, a blade spacer pin aperture 62, and a spacer pin aperture 64.

Referring to FIGS. 7A-7D, an example second push member 18*b* is configured to compress a strain relief portion of the connector, and thus may be referred to herein as a strain relief push member 18*b*. The example strain relief push member 18*b* includes a flat compression edge 66 configured to compress a strain relief portion of the connector so as to seat wiring within the strain relief portion.

The strain relief push member further includes a guide pin aperture 58 and a spacer pin aperture 64.

Although two push members 18*a*, 18*b* are illustrated and described with respect to the example tool 10, the instant disclosure is not limited to exactly two push members. In other examples, a single push member or more than two push members may be provided, depending on the requirements of the connectors for which the tool 10 is intended. Furthermore, although two different, specific example push members (i.e., a contact push member 18*a* and a strain relief push member 18*b*) are illustrated and described, the instant disclosure is not limited to these specific push members 18*a*, 18*b*. Different push members may be used in different examples, and multiple different push members or multiple similar push members may be used in a single example tool.

Referring to FIGS. 1, 2, and 5A-5D, an example push rod 20 translates rotational movement of the handle 12 into linear movement of the push members 18*a*, 18*b*. In the example tool 10, the push rod 20 is coupled to the handle 12 and to the push members 18*a*, 18*b*, and therefore couples the push members 18*a*, 18*b* to the handle 12 indirectly. The example push rod 20 includes a top 68 and two sidewalls 70 that are generally perpendicular to the top 68. The sidewalls 70 of the example push rod 20 have complementary guide pin apertures 72 and push rod pin apertures 74.

Figure 4A:
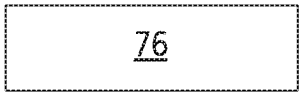
FIGS. 4A-4C are various views of an example push rod pin of the example modular connector crimp tool of FIG. 1.
Figure 4B:
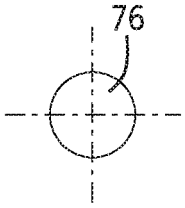
Figure 4C:
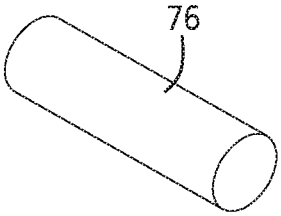
Figure 5A:
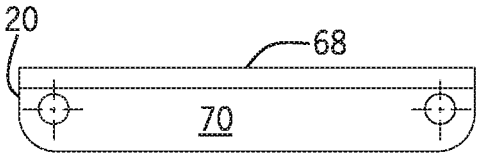
FIGS. 5A-5D are various views of an example push rod of the example modular connector crimp tool of FIG. 1.
Figure 5C:
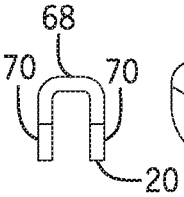
Figure 5D:
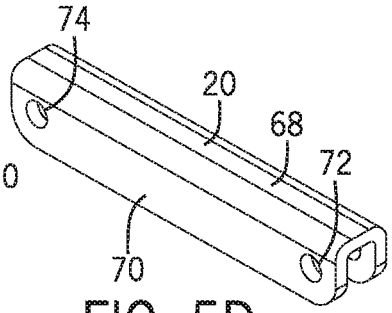
Figure 5B:
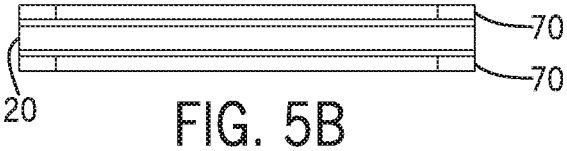
Figure 6A:
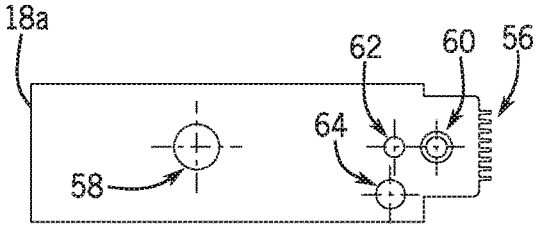
FIGS. 6A-6D are various views of an example contact push member of the example modular connector crimp tool of FIG. 1.
Figure 6C:
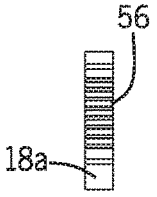
Figure 6B:
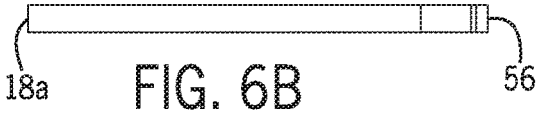
Figure 6D:
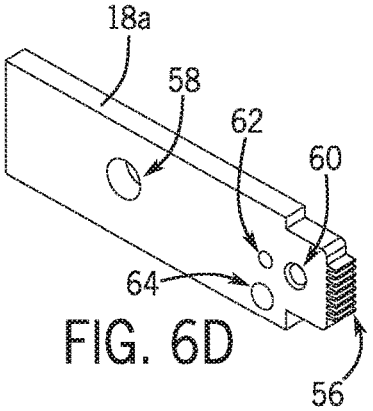
Figure 7A:
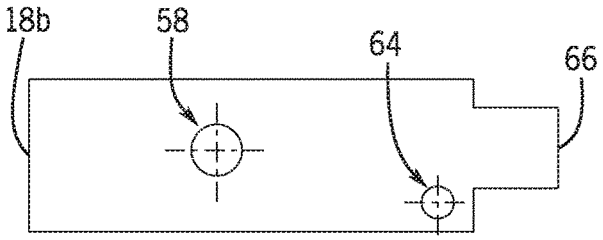
FIGS. 7A-7D are various views of an example contact push member of the example modular connector crimp tool of FIG. 1.
Figure 7C:
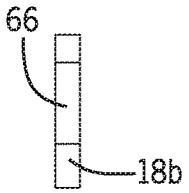
Figure 7B:
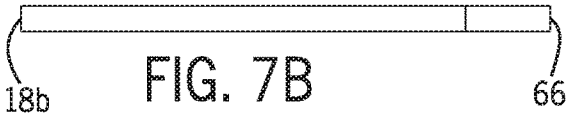
Figure 7D:
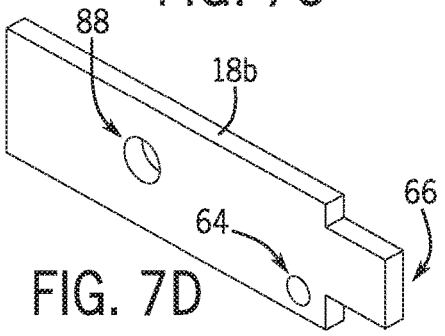
Figure 8A:
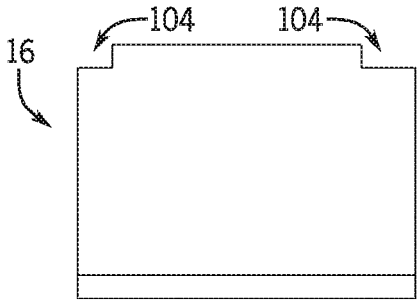
FIGS. 8A-8E are various views of an example receptacle of the example modular connector crimp tool of FIG. 1.
Figure 8B:
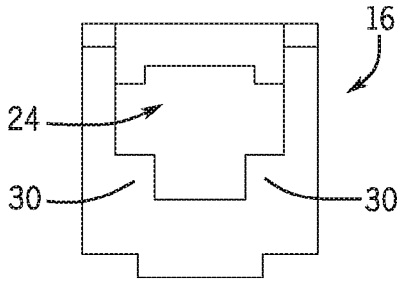
Figure 8C:
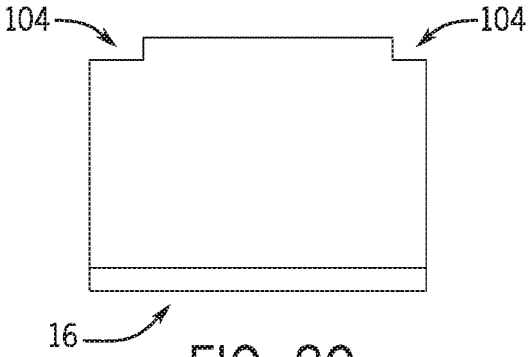
Figure 8E:
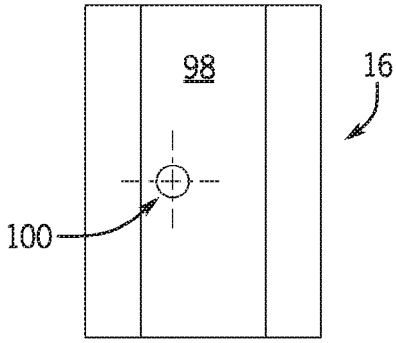
Figure 8D:
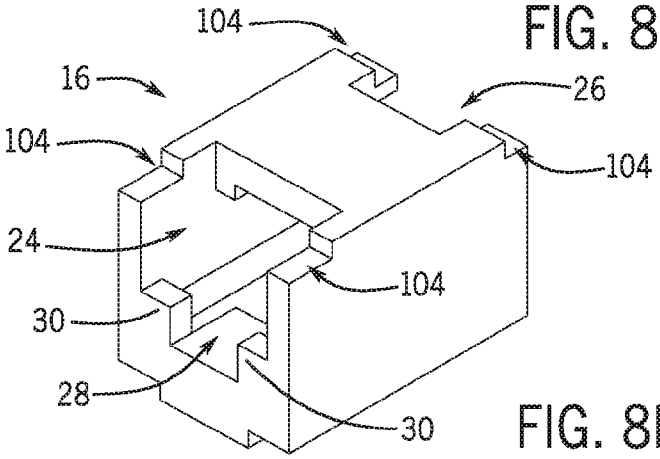
Figure 14A:
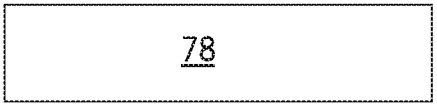
FIGS. 14A-14C are various views of an example guide pin of the example modular connector crimp tool of FIG. 1.
Figure 14B:
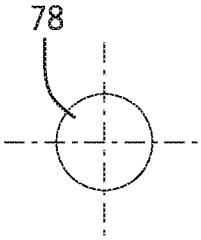
Figure 14C:
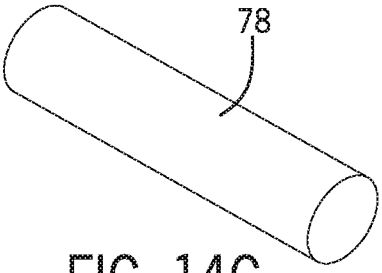
Figure 15A:
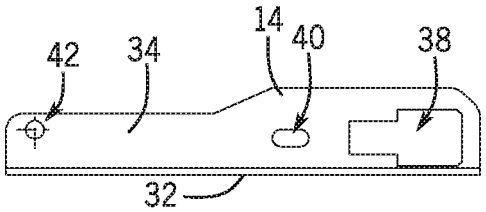
FIGS. 15A-15D are various views of an example frame of the example modular connector crimp tool of FIG. 1.
Figure 15B:
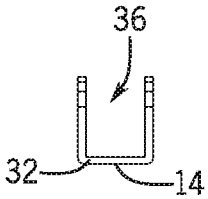
Figure 15C:
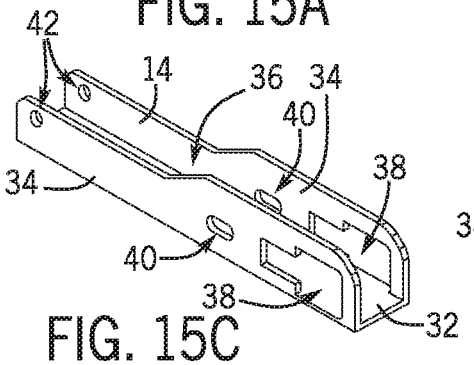
Figure 15D:
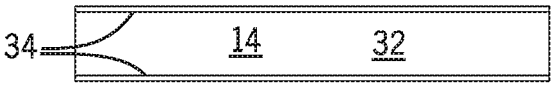

As shown in FIGS. 1 and 2, in the example tool 10, the push rod 20 is coupled to the handle 12 with a push rod pin 76 (an example push rod pin 76 is shown in detail in FIGS. 4A-4C) disposed in the push rod pin apertures 74 of the push rod sidewalls 70 and in the push rod pin apertures 52 of the handle base portion 46. The push rod 20 is coupled to the push members 18*a*, 18*b* with a guide pin 78 (the guide pin 78 is shown in detail in FIGS. 14A-14C; the coupling of the push rod 20 to the push members 18*a*, 18*b* with the guide pin 78 is shown best in FIG. 2). The guide pin 78 further extends into guide openings 40 in the sidewalls 34 of the frame 14 (see FIG. 1).

Figure 17A:
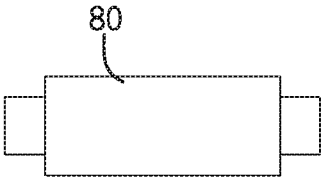
FIGS. 17A-17C are various views of an example spacer pin of the example modular connector crimp tool of FIG. 1.
Figure 17B:
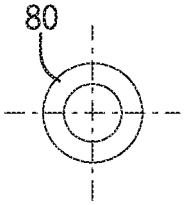
Figure 17C:
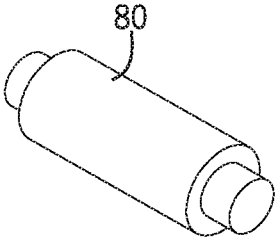
Figure 18A:
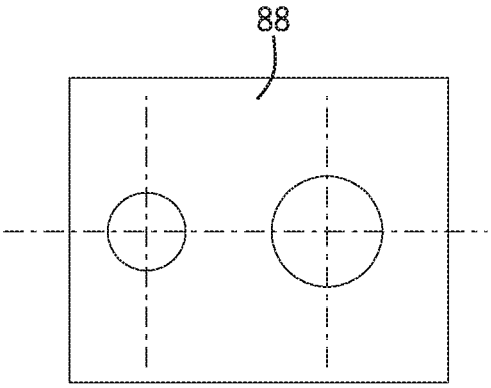
FIGS. 18A-18D are various views of an example blade spacer of the example modular connector crimp tool of FIG. 1.
Figure 18B:
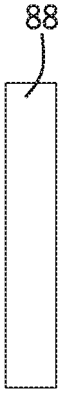
Figure 18C:
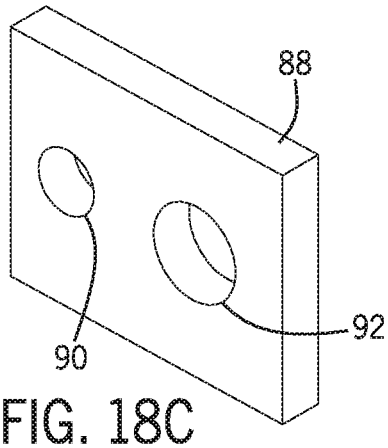
Figure 18D:
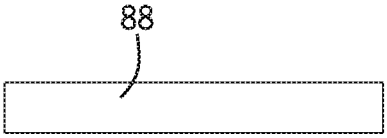

As noted above, the push members 18*a*, 18*b* are both coupled to the push rod 20 through the guide pin 78, in the example tool. The push members 18*a*, 18*b* may be further coupled to each other with a spacer pin 80 (tan example spacer pin 80 is shown in detail in FIGS. 17A-17C), in the example tool, that is disposed between the push members 18*a*, 18*b* and in the interior 36 of the frame 14. In the example tool 10, the spacer pin 80 maintains a constant separation between the push members 18*a*, 18*b* to ensure that the push members 18*a*, 18*b* apply force to the desired portions of a connector disposed in the receptacle 16.

Referring to FIGS. 1, 2, and 12A-12D, the blade 22 is rigidly coupled to the contact push member 18*a*, in the example tool. An example blade 22 includes a tapered cutting edge 82, a blade screw aperture 84, and a blade spacer pin aperture 86. Due to the rigid coupling between the blade 22 and the contact push member 18*a* and the positioning of the blade 22, when the contact push member 18*a* is actuated to crimp the contact portion of a connector disposed within the receptacle 16, the blade 22 cuts excess wiring from the connector. Such excess wiring may result from a user inserting too much wire length into the connector, or the wire slipping out, before the connector is crimped.

The blade 22 is spaced from the contact push member 18*a* by a blade spacer 88 (an example blade spacer 88 is shown in FIGS. 18A-18D; the blade spacer 88 is obscured by the blade 22 in FIGS. 1 and 2) disposed between the blade 22 and the contact push member 18*a*, in the example tool 10. The blade spacer 88 includes a blade screw aperture 90 and a blade spacer pin aperture 92.

Figure 13A:
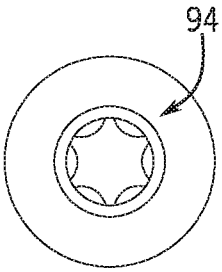
FIGS. 13A-13C are various views of an example blade screw of the example modular connector crimp tool of FIG. 1.
Figure 13B:
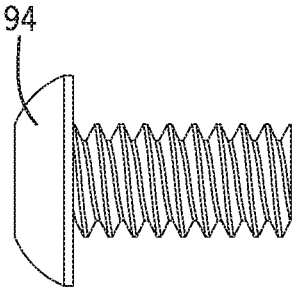
Figure 13C:
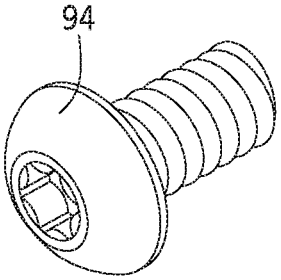
Figure 19A:
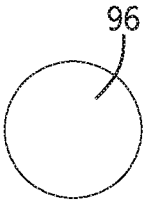
FIGS. 19A-19C are various views of an example blade spacer pin of the example modular connector crimp tool of FIG. 1.
Figure 19B:
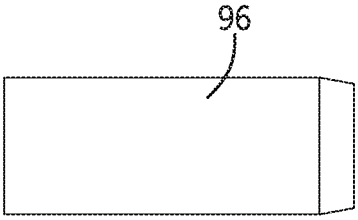
Figure 19C:
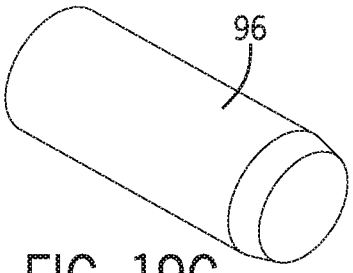

The blade 22 is coupled to the contact push member 18*a* and to the blade spacer 88 with a blade screw 94 disposed in the blade screw aperture 84 of the blade 22, in the blade screw aperture 90 of the blade spacer 88, and in the blade screw aperture 60 of the contact push member 18*a*, in the example tool 10. An example blade screw 94 is illustrated in detail in FIGS. 13A-13C. The blade 22 is further coupled to the contact push member 18*a* and the blade spacer 88 by a blade spacer pin 96 (an example blade spacer pin 96 is shown in detail in FIGS. 19A-19C) disposed in the blade spacer pin aperture 86 of the blade 22, the blade spacer pin aperture 92 of the blade spacer 88, and the blade spacer pin aperture 62 of the contact push member 18*a*.

As an alternative to the blade 22 being rigidly coupled to the contact push member 18*a*, the blade 22 may be otherwise included in or on the tool 10 so as to cut excess wiring from a connector disposed in the receptacle 16. For example, in one alternative, the blade 22 may be slidably coupled to the frame 14. In such an alternative, the blade 22 may be separately actuable by a user (i.e., separately from the handle 12), or may be indirectly coupled to the handle 12 so as to actuate and cut excess wiring responsive to actuation of the handle. In another alternative, the blade 22 may be slidably coupled with the receptacle 16. In such an alternative, the blade 22 may be separately actuable by a user (i.e., separate from the handle 12), or may be indirectly coupled to the handle 12 so as to actuate and cut excess wiring responsive to actuation of the handle 12. It should be noted that such alternatives, along with the rigid coupling between the blade 22 and the contact push member 18*a* of the example tool 10 illustrated in FIGS. 1 and 2, are not mutually exclusive. The blade 22 may be rigidly and/or slidably coupled with numerous elements of the tool in a single example.

In operation, a user may operate the tool 10 by holding the frame 14 and handle 12 or by placing the frame 14 on a surface, such as a table or workbench. The user may place a connector into the receptacle 16, inserting the connector until the end of the connector abuts the end of the cavity 24 of the receptacle 16. The user may then, or may have already, inserted the electrical wiring of a cable into the connector. The user may then push down on the handle 12, rotating the handle 12 towards the frame 14, to actuate the handle 12 with respect to the frame 14. Responsive to the user actuating the handle 12, the push members 18*a*, 18*b* may apply compressive forces to portions of the connector to rigidly seat the electrical wiring in the connector, and the blade 22 may cut excess wiring from the end of the connector. The user may then pull up on the handle 12 (i.e., away from the frame 14) and remove the connector.

A method of assembling a portion of the example tool 10 will now be described with reference to FIGS. 20-26. The method illustrated will include steps for securing the receptacle 16 within the interior 36 of the frame 14. Other aspects of the assembly of the tool 10, such as coupling the handle 12, frame 14, push rod 20, blade 22, and push members 18*a*, 18*b* with each other can be performed by one of skill in the art according to the descriptions of such couplings in this disclosure. Accordingly, although the method will be described with reference to various stages of assembly, (i.e., "first," "second," etc.), it should be understood that such sequential stage descriptions are for ease of reference only and within the context of the described method. Prior, additional, and/or intermediate assembly steps may be required to assemble the full tool. Some steps illustrated and/or described may not be necessary, in some examples, and steps may be performed in a different order than described, in some examples.

Figure 20:
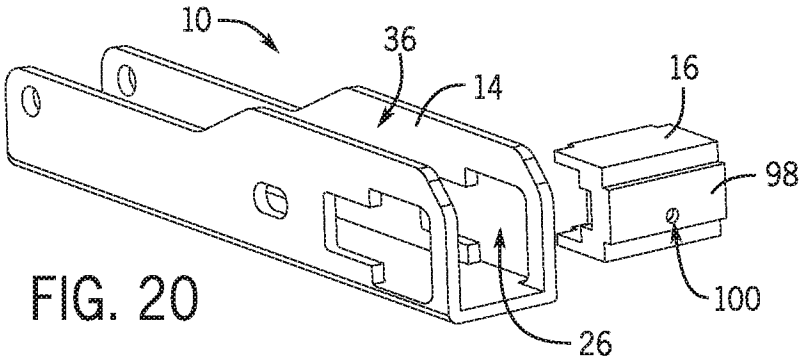
FIG. 20 is an isometric view of the example modular connector crimp tool of FIG. 1 at a first stage of assembly.

FIG. 20 illustrates the example tool 10 in a first stage of assembly. The receptacle 16 may be positioned adjacent the first opening 26 of the frame 14 and inserted through the first opening 26.

Referring to FIGS. 8B, 8D, 21A, and 21B, the example receptacle includes an end surface 98 having a retainer screw aperture 100 and the example receptacle 16 further includes sidewalls 102 extending from the end surface 98. The sidewalls 102 have notches 104 configured to mate with corresponding protrusions 106 or surfaces on the frame 14.

Figure 21B:
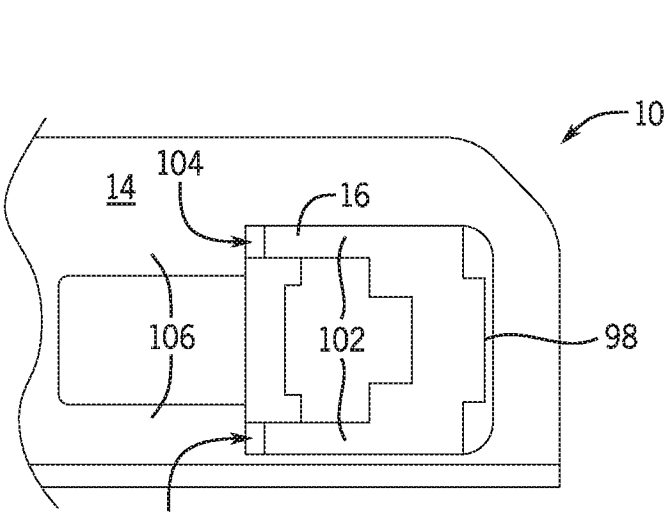
FIGS. 21A-21B are views of the example modular connector crimp tool of FIG. 1 at a second stage of assembly.
Figure 21A:
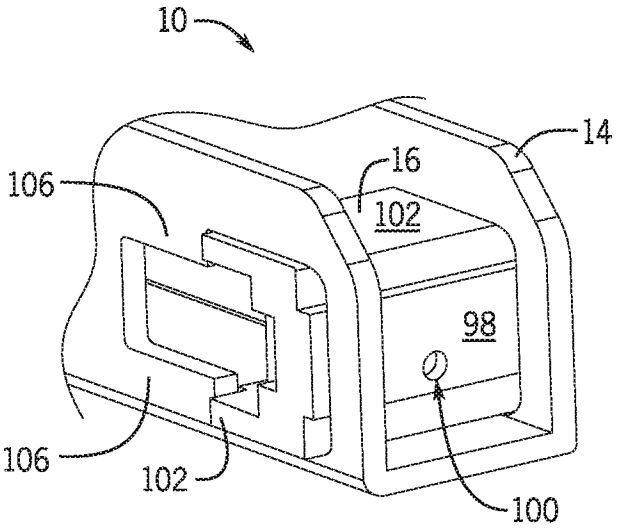
Figure 22B:
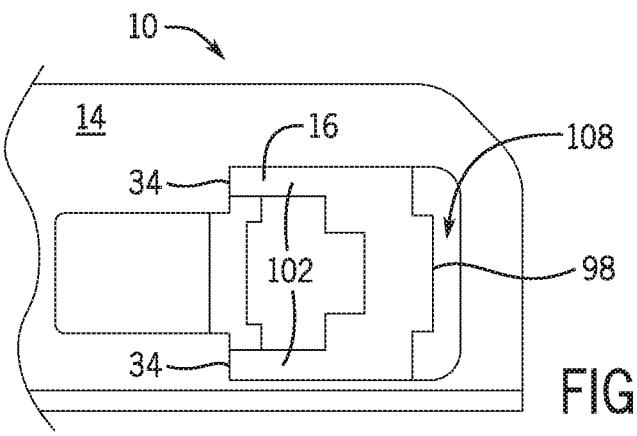
FIGS. 22A-22B are views of the example modular connector crimp tool of FIG. 1 at a third stage of assembly.
Figure 22A:
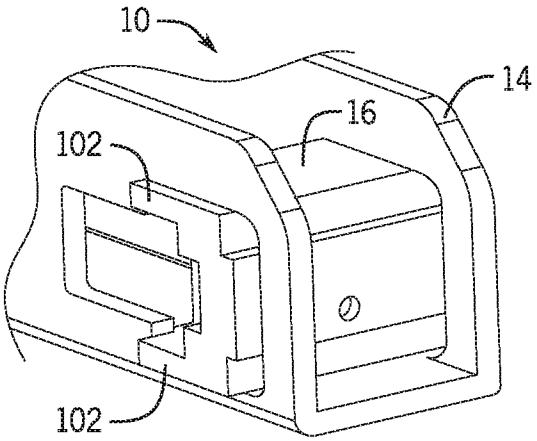

With continued reference to FIGS. 21A-21B, the receptacle 16 may be inserted into the frame 14 until the notches 104 in the receptacle sidewalls 102 meet the corresponding protrusions 106 or surfaces on the frame 14. The receptacle 16 may then be pushed "forward" until the ends of the sidewalls 102 of the receptacle 16 are flush with the sidewalls 34 of the frame 14. FIGS. 22A-22B illustrate the receptacle 16 inserted to its forward-most position.

Figure 23B:
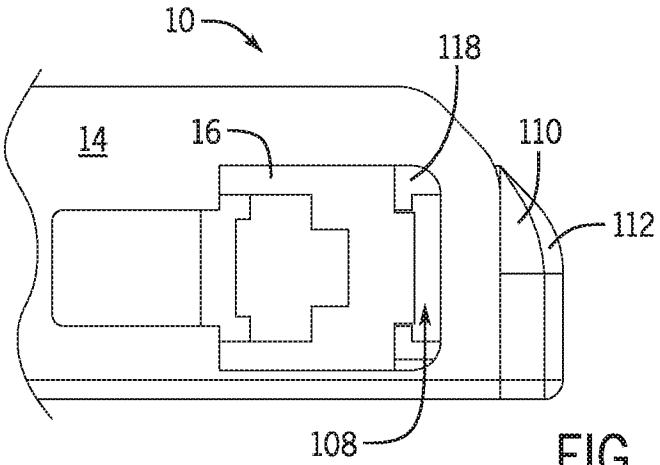
FIGS. 23A-23B are views of the example modular connector crimp tool of FIG. 1 at a fourth stage of assembly.
Figure 23A:
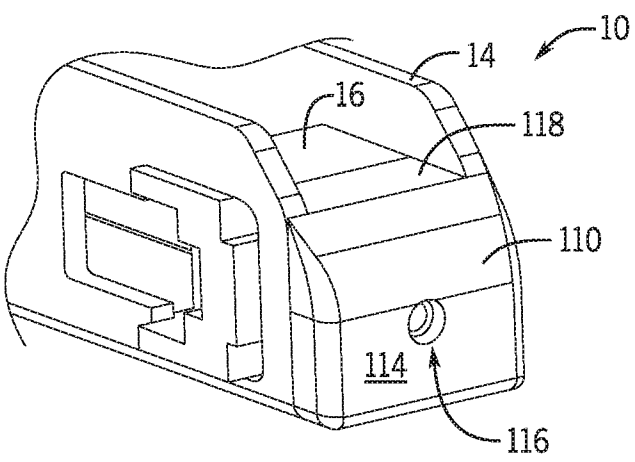

As shown in FIGS. 22A-22B, with the receptacle 16 in its forward-most position, a gap 108 exists between the frame 14 and the end surface 98 of the receptacle 16, in the example tool 10. Referring to FIGS. 23A-23B, a retainer 110 may be inserted into the end of the frame 14. An example retainer 110 is shown in detail in FIGS. 10A-10D. The example retainer 110 includes a cap 112 having an end surface 114 and a retainer screw aperture 116. The example retainer 110 further includes a body 118 defining a back plate slot 120. When the example tool 10 is assembled, the body 118 of the example retainer 110 abuts a portion of the receptacle 16, as shown in FIG. 23B.

Figure 11A:
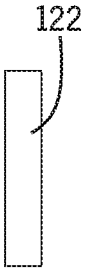
FIGS. 11A-11C are various views of an example back plate of the example modular connector crimp tool of FIG. 1.
Figure 11B:
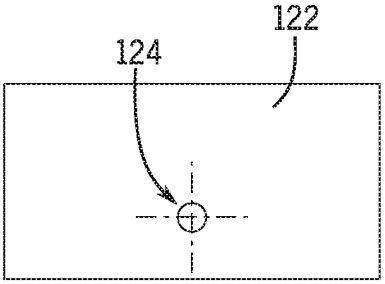
Figure 11C:
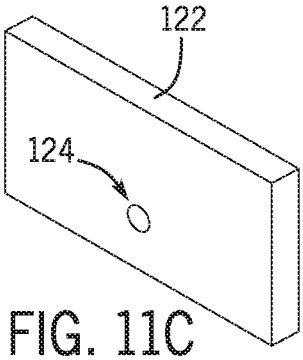
Figure 12A:
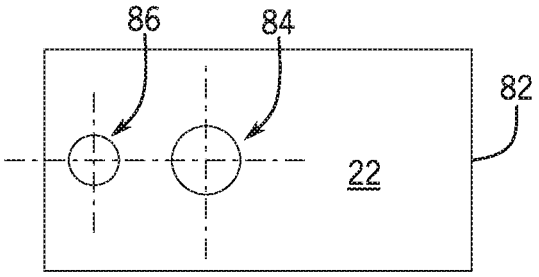
FIGS. 12A-12D are various views of an example blade of the example modular connector crimp tool of FIG. 1.
Figure 12B:
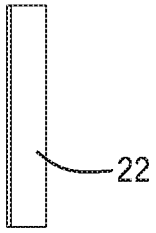
Figure 12C:
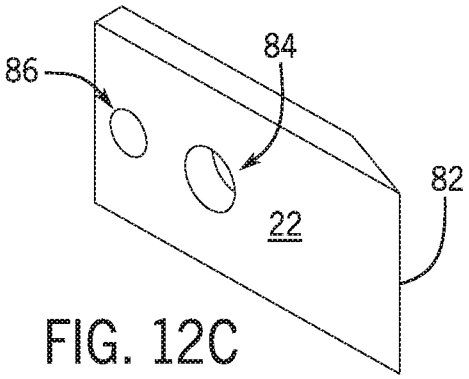
Figure 12D:
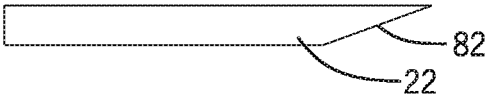
Figure 24:
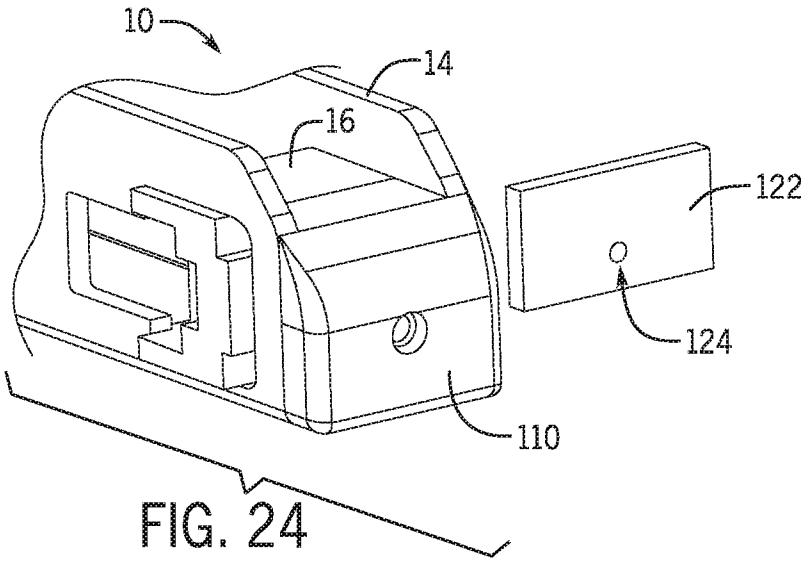
FIG. 24 is an isometric view of the example modular connector crimp tool of FIG. 1 at a fifth stage of assembly.

Referring to FIG. 24, a back plate 122 may be placed adjacent the example tool 10 for insertion into the back plate slot 120 of the retainer 110. An example back plate 122 is shown in detail in FIGS. 11A-11C. The example back plate 122 includes a retainer screw aperture 124.

Figure 25B:
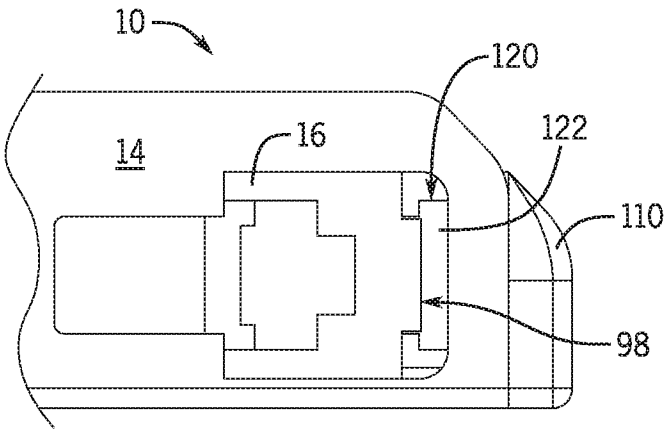
FIGS. 25A-25B are views of the example modular connector crimp tool of FIG. 1 at a sixth stage of assembly.
Figure 25A:
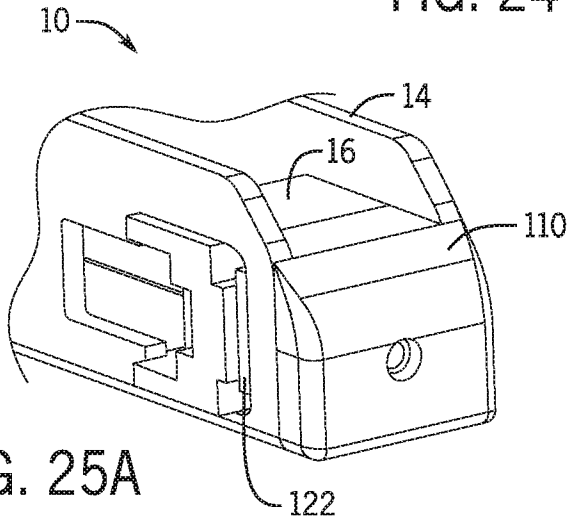

FIGS. 25A-25B illustrate the example tool 10 after insertion of the back plate 122 into the back plate slot 120 of the retainer 110. Once inserted, the back plate abuts a portion of the end surface 98 of the receptacle 16 and also abuts the frame 14 so as to fill the gap 108 between the end surface 98 of the receptacle 16 and the frame 14 (the gap 108 is best shown in FIGS. 22B and 23B).

Figure 9A:
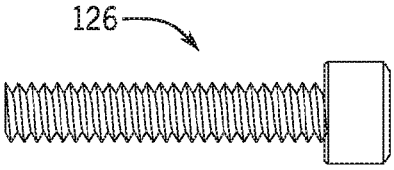
FIGS. 9A-9C are various views of an example retainer screw of the example modular connector crimp tool of FIG. 1.
Figure 9B:
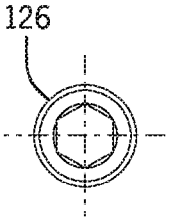
Figure 9C:
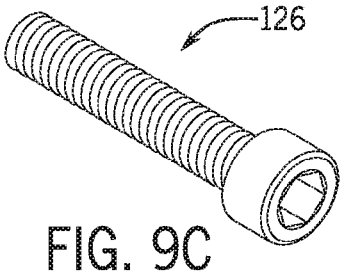
Figure 10A:
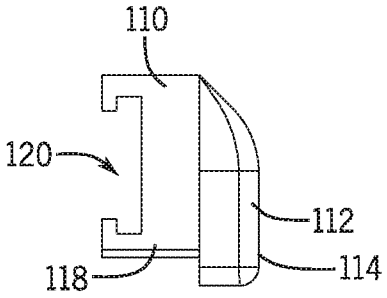
FIGS. 10A-10D are various views of an example retainer of the example modular connector crimp tool of FIG. 1.
Figure 10B:
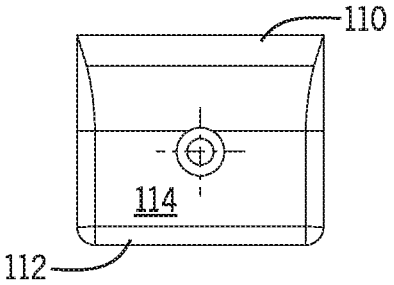
Figure 10C:
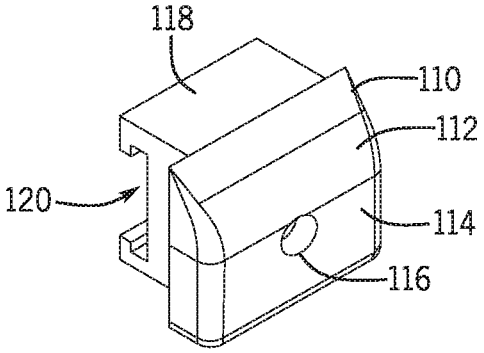
Figure 10D:
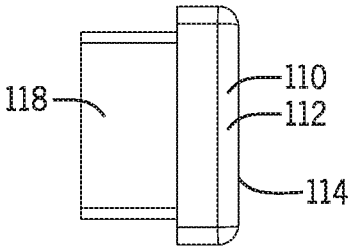
Figure 26:
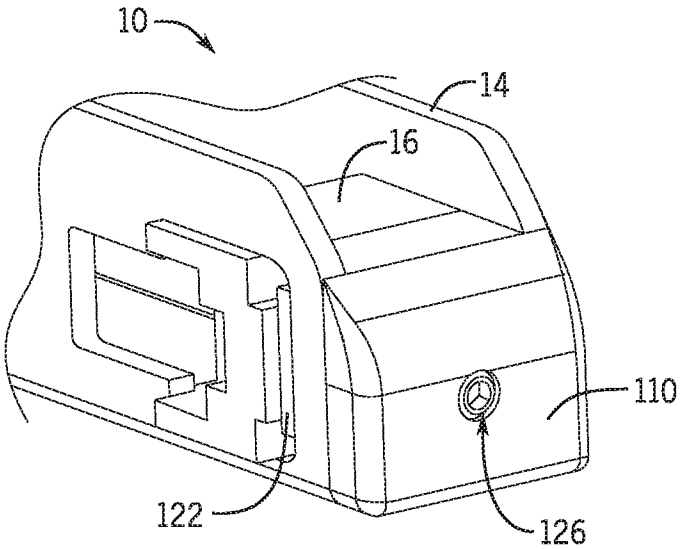
FIG. 26 is an isometric view of the example modular connector crimp tool of FIG. 1 at a seventh stage of assembly.
Figure 27:
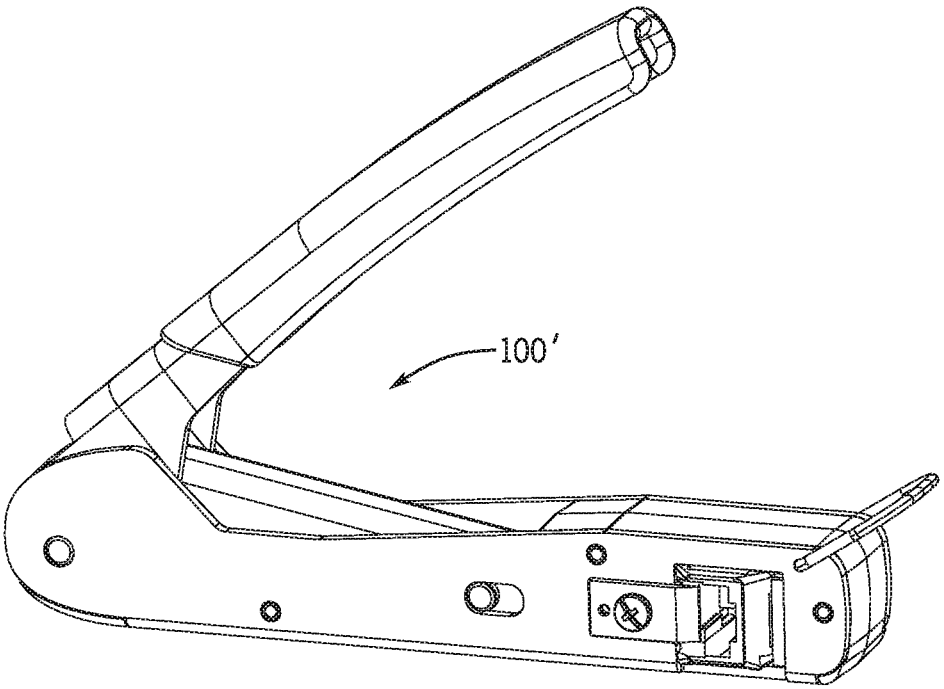
FIG. 27 is an isometric view of an example modular connector crimp tool.

Referring to FIG. 26, a retainer screw 126 is inserted into the retainer screw aperture 116 of the retainer 110, the retainer screw aperture 124 of the back plate 122, and the retainer screw aperture 100 of the end surface 98 of the receptacle 16 to secure the receptacle 16 within the frame 14. An example retainer screw 126 is shown in detail in FIGS. 9A-9C.

A crimp tool 10 according to the present disclosure provides numerous advantages. First, the rotational linkage/coupling between the handle 12 and the push members 18*a*, 18*b* (through the push rod 20) multiplies the force applied by the user, thus requiring less user force to achieve the same result relative to known crimp tools. Second, the arrangement of the blade 22 adjacent to the receptacle 16 and the configuration of the blade 20 so as to move responsive to actuation of the handle 12 provide more efficient removal of excess wiring relative to known crimp tools. Third, the arrangement of the receptacle 16 and frame 14 enable simplified assembly that can be performed with simple tools, as demonstrated with respect to FIGS. 20-26.

With reference now to FIGS. 27-62, the modular plug crimp tool 100' seats the plug contacts, sets the strain relief, and trims off the fed through wires (when applicable) of a modular plug connector, such as for example an RJ-45 connector. A force is exerted to a handle 1', which is hingedly connected to a push rod 19' by a push rod pin 2'. The handle 1' is hingedly connected to the body 5' by the handle anchor pin 4'. The force exerted to the handle 1' is transferred and multiplied to the contact pusher 8' and strain relief pusher 17' through the push rod 19' taking advantage of the mechanical advantage to be gained from a toggle mechanism. The contact pusher 8' and strain relief pusher 17' are held in close proximity to the inside of the side walls of the body 5' by the outside surfaces of the push rod 19' and a spacer pin 10'. The contact pusher 8' and strain relief pusher 17' are held in close proximity to the inside of the bottom wall of the body 5' by a guide pin 9', which slides within guide slots in the side walls of the body 5'. The guide slots in side walls of the body 5' also limit the tools open and closed positions.

A blade 12' is attached to the contact pusher 8', while being spaced from the contact pusher 8' by a blade spacer 20'. The blade spacer 20' has a thickness to position the blade 12' precisely to cut wires that are fed through a feed-through modular plug while the modular plug is being crimped. Both the blade spacer 20' and the blade 12' are connected to the contact pusher 8' with a blade screw 11'. When a modular plug is inserted into the modular plug nest 13', the modular plug nest 13' precisely holds the modular plug in position so that the contact pusher 8' and strain relief pusher 17' engage the contacts and strain relief respectively of the modular plug.

As the handle 1' is depressed to the tool closed position, which is limited by the guide pin 9' within the guide slots, the contact pusher 8' and strain relief pusher 17' are forced to crimp the contacts and strain relief of the modular plug. When a feed-through modular plug is being crimped, the wires that are fed through the modular plug are also trimmed by the blade 12' at the same time that the connector is crimped. The distance between the inside surfaces of the side walls of the body 5' and the relative positioning of the modular plug nest 13' to the side walls of the body 5' are crucial to insure that the contact pusher 8' and strain relief pusher 17' are aligned with the contacts and strain relief of the modular plug. The way that the modular plug nest 13' is assembled to the body 5' is novel. The nest slots in the side walls of the body 5' are sized to receive the modular plug nest 13'. Once the modular plug nest 13' is inserted through the nest slots in the side walls of the body 5' so that external mate surfaces on the modular plug nest 13' align with the internal surfaces of the body 5', the modular plug nest 13' is slid toward the handle anchor pin 4'. The front end of the modular plug nest 13' at this point would be secured within the body. The end cap 15', back plate 14', and roll pins 6' are then assembled to completely fix the modular plug nest 13'.

A heal cap 3' retains the handle anchor pin 4' and covers internal components. A spring 7' creates a force to open the tool so that it is self-opening. The spring 7' is retained by the roll pin 6' and the push rod retainer pin 21'. A hasp 16' keeps the handle 1' in a closed position when the tool is stored. A push rod retainer 18' retains the guide pin 9'. A push rod retainer pin 21' retains the spring 7' and the push rod retainer 18' for later assembly.

Figure 28:
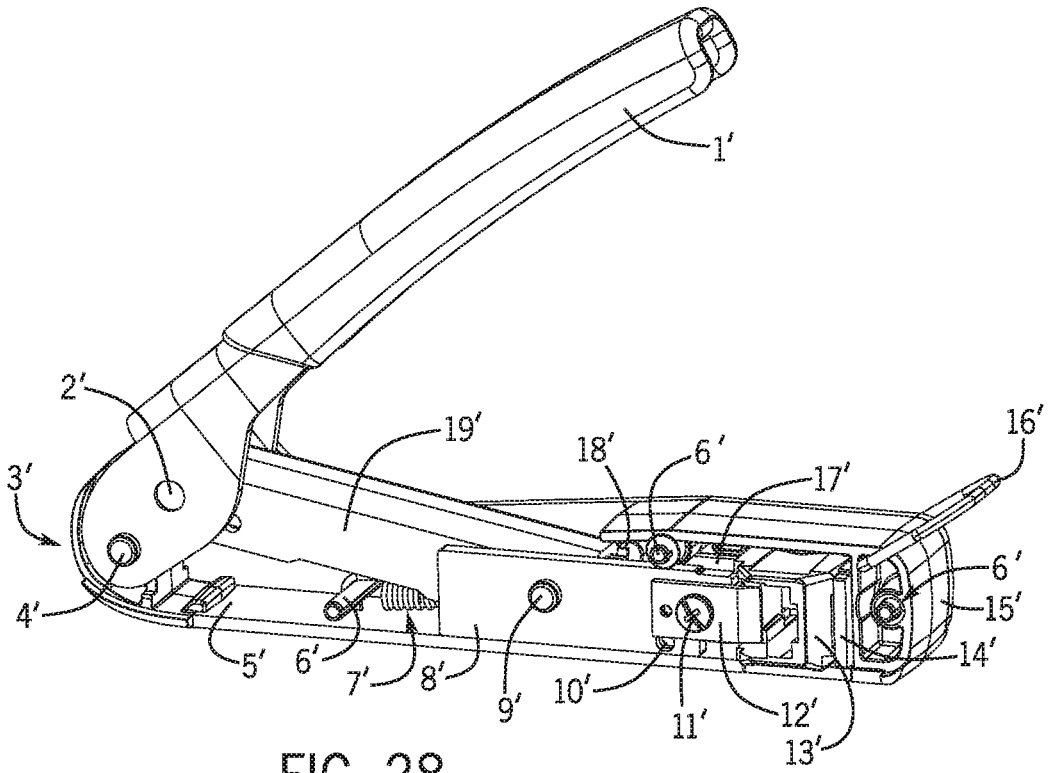
FIG. 28 is another isometric view of the tool of FIG. 27 with the front side wall removed for clarification.
Figure 29A:
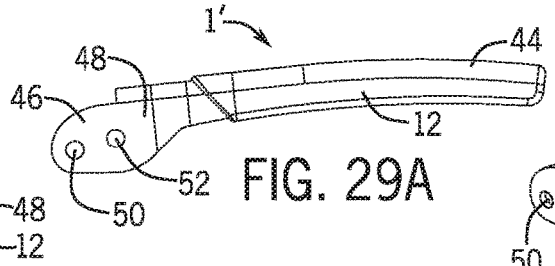
FIGS. 29A-29D illustrate an example handle 1' of the tool of FIG. 27.
Figure 29C:
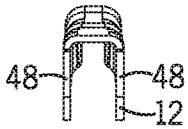
Figure 29D:
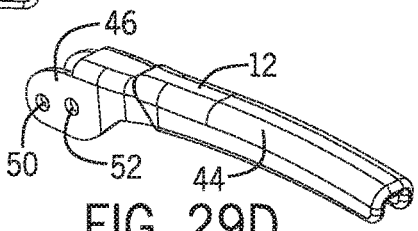
Figure 29B:
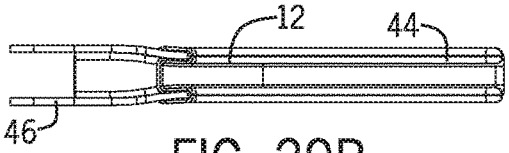
Figure 30B:
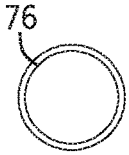
FIGS. 30A-30C illustrate an example Push Rod Pin 2' of the tool of FIG. 27.
Figure 30A:
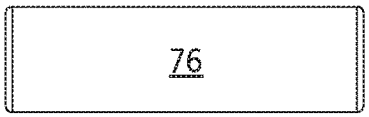
Figure 30C:
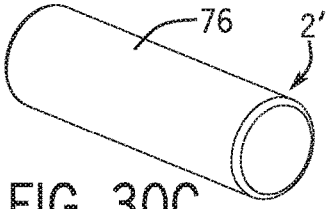
Figure 31B:
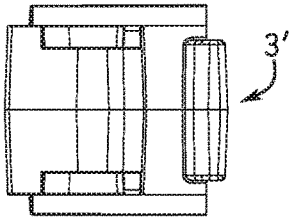
FIGS. 31A-31E illustrate an example heal cap 3' of the tool of FIG. 27.
Figure 31E:
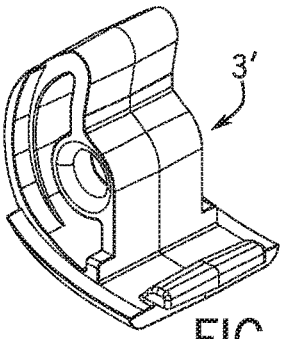
Figure 31A:
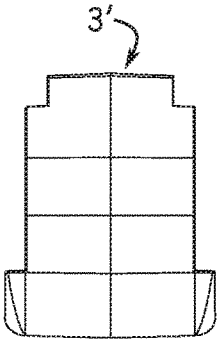
Figure 31C:
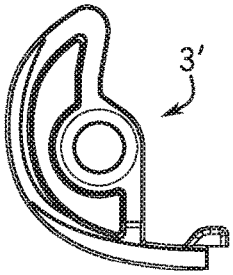
Figure 31D:
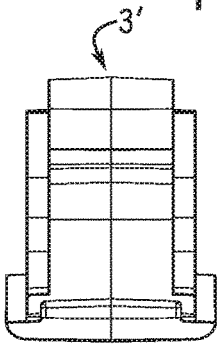
Figure 32A:
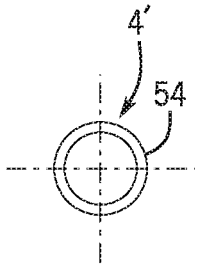
FIGS. 32A-32C illustrate an example handle anchor pin 4' of the tool of FIG. 27.
Figure 32B:
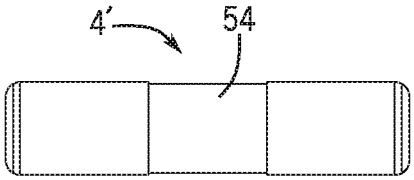
Figure 32C:
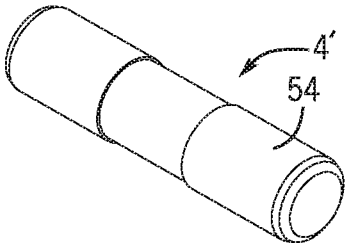
Figure 33A:
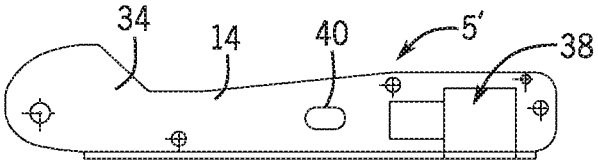
FIGS. 33A-33D illustrate an example body 5' of the tool of FIG. 27.
Figure 33C:
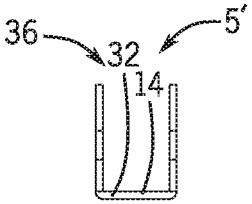
Figure 33B:
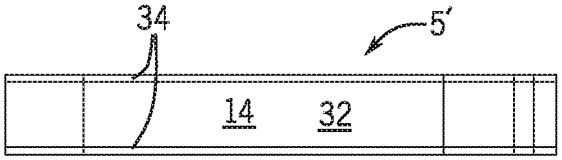
Figure 33D:
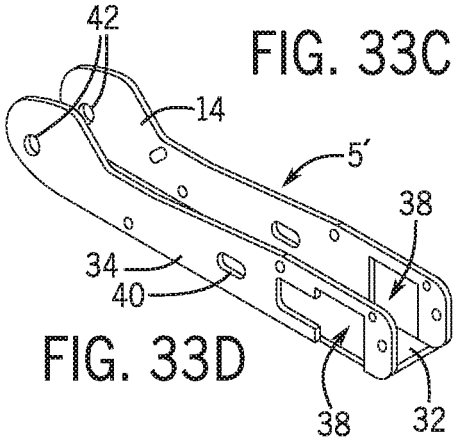
Figure 34A:
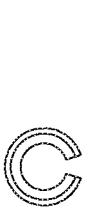
FIGS. 34A-34C illustrate an example roll pin 6' of the tool of FIG. 27.
Figure 34B:
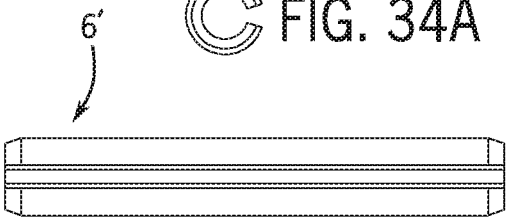
Figure 34C:
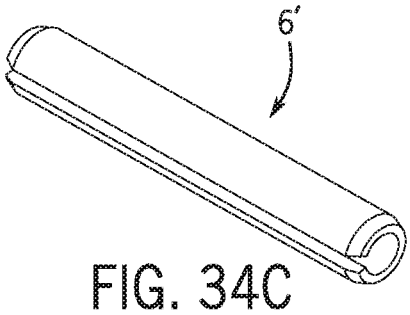
Figure 35A:
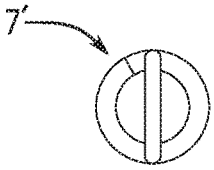
FIGS. 35A-35D illustrate an example extension spring 7' of the tool of FIG. 27.
Figure 35B:
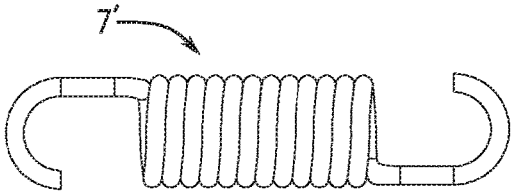
Figure 35C:
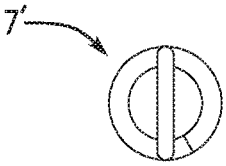
Figure 35D:
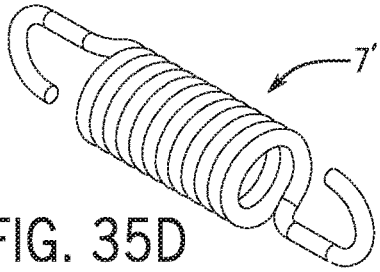
Figure 36A:
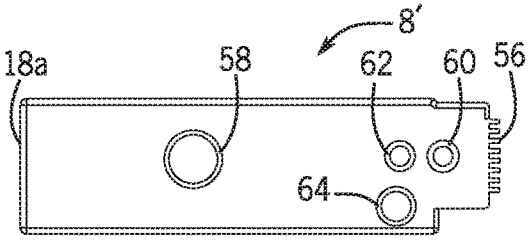
FIGS. 36A-36D illustrate an example contact pusher 8' of the tool of FIG. 27.
Figure 36B:
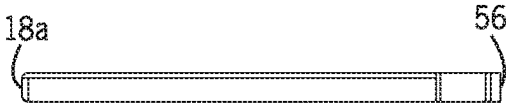
Figure 36C:
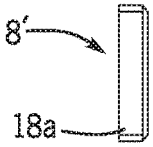
Figure 36D:
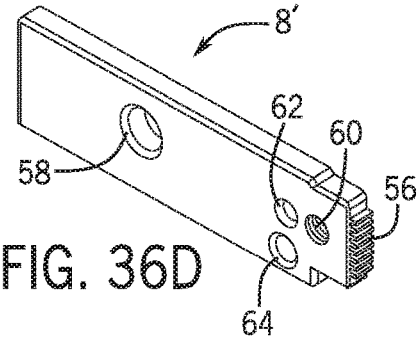
Figure 37A:
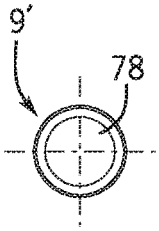
FIGS. 37A-37C illustrate an example guide pin 9' of the tool of FIG. 27.
Figure 37B:
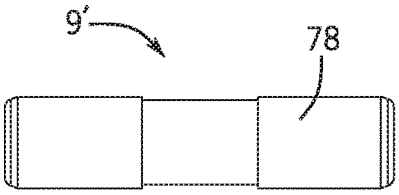
Figure 37C:
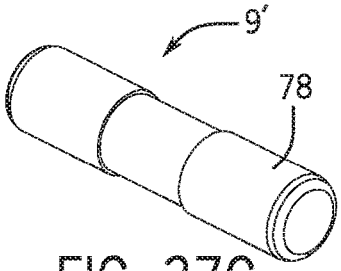
Figure 38A:
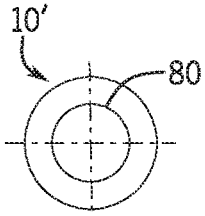
FIGS. 38A-38C illustrate an example spacer pin 10' of the tool of FIG. 27.
Figure 38B:
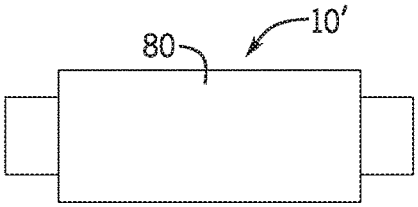
Figure 38C:
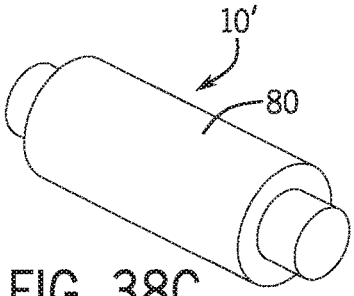
Figure 39A:
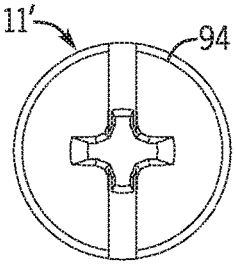
FIGS. 39A-39C illustrate an example blade screw 11' of the tool of FIG. 27.
Figure 39B:
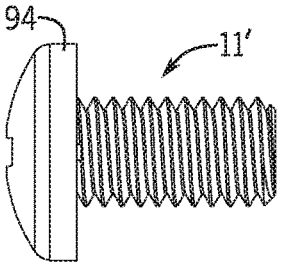
Figure 39C:
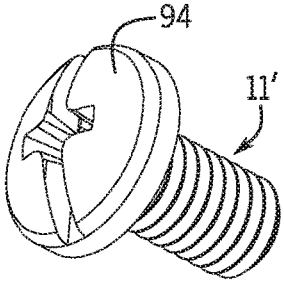
Figure 40A:
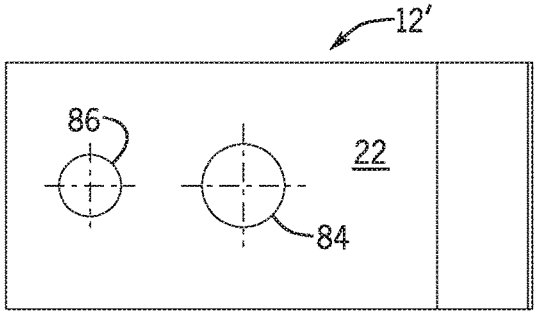
FIGS. 40A-40C illustrate an example blade 12' of the tool of FIG. 27.
Figure 40C:
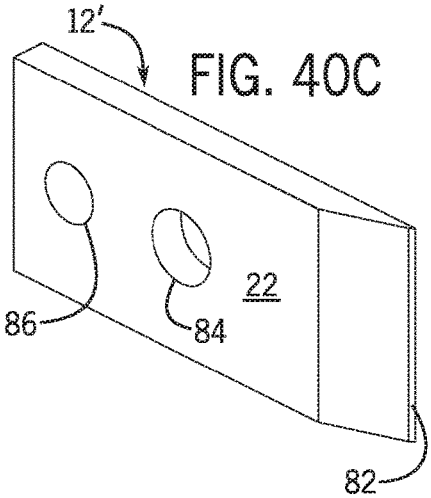
Figure 40B:
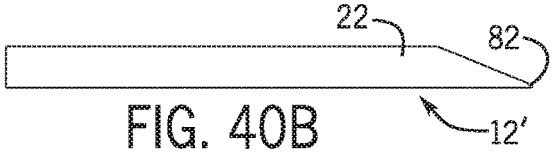
Figure 41A:
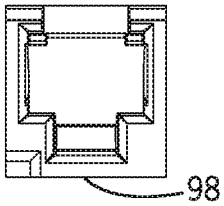
FIGS. 41A-41E illustrate an example modular plug nest 13' of the tool of FIG. 27.
Figure 41B:
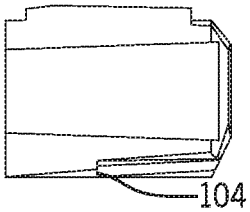
Figure 41E:
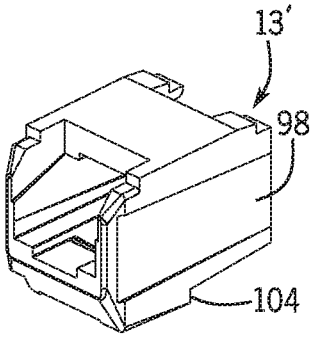
Figure 41C:
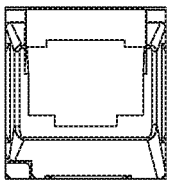
Figure 41D:
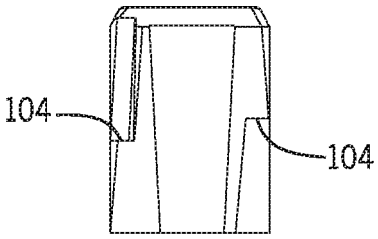
Figure 42A:
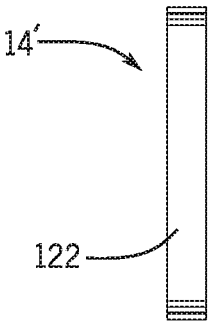
FIGS. 42A-42D illustrate an example back plate 14' of the tool of FIG. 27.
Figure 42B:
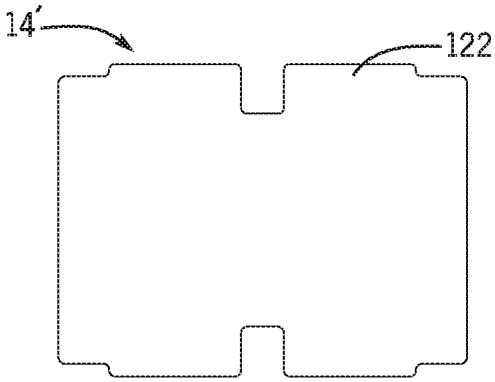
Figure 42C:
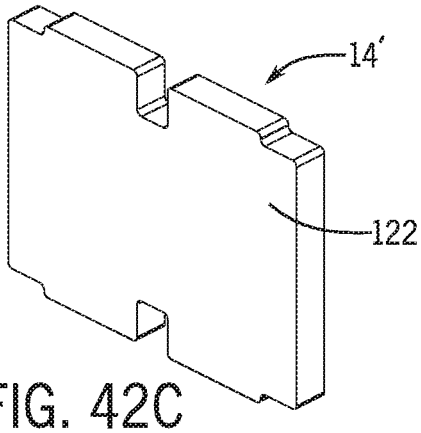
Figure 42D:
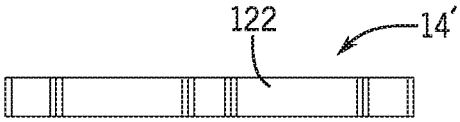
Figure 43A:
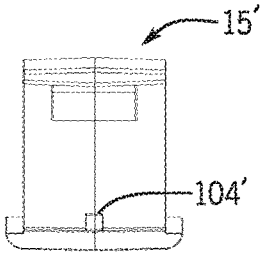
FIGS. 43A-43D illustrate an example end cap 15' of the tool of FIG. 27.
Figure 43B:
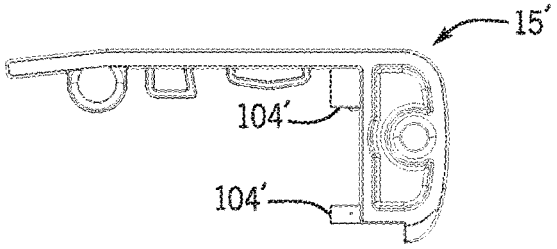
Figure 43C:
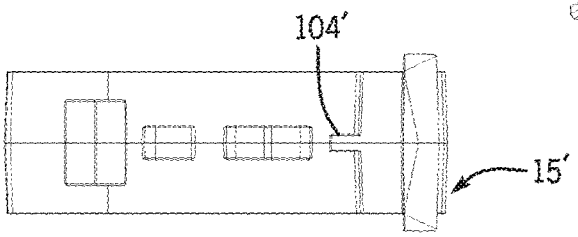
Figure 43D:
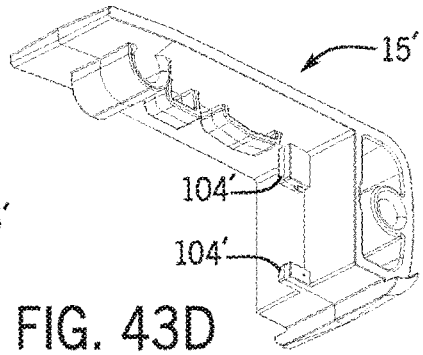
Figure 44A:
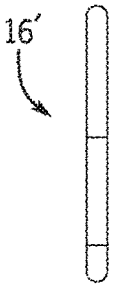
FIGS. 44A-44D illustrate an example hasp 16' of the tool of FIG. 27.
Figure 44B:
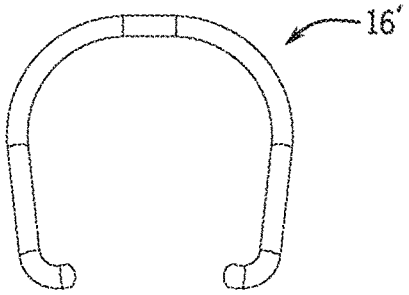
Figure 44C:
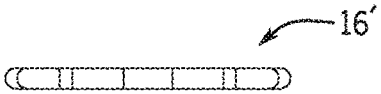
Figure 44D:
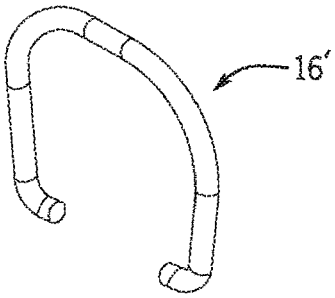
Figure 47A:
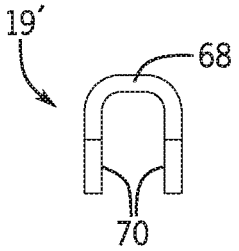
FIGS. 47A-47D illustrate an example push rod 19' of the tool of FIG. 27.
Figure 47B:
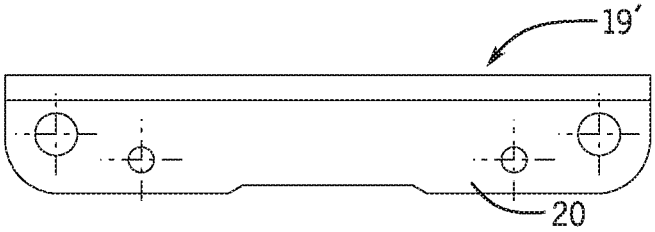
Figure 47C:
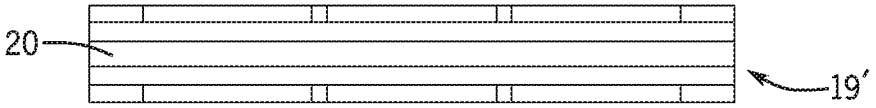
Figure 47D:
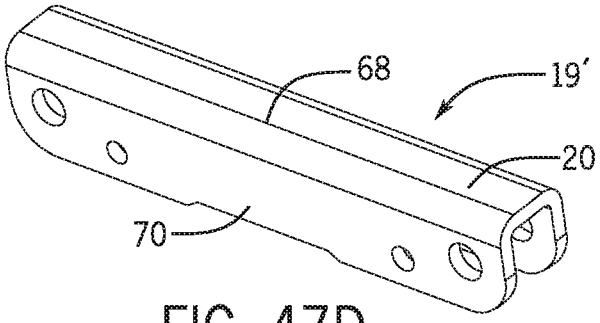
Figure 48A:
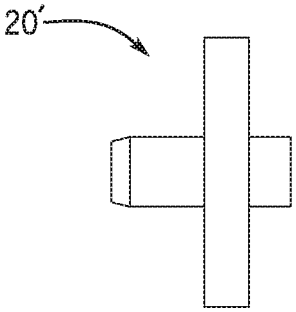
FIGS. 48A-48D illustrate an example blade spacer 20' of the tool of FIG. 27.
Figure 48B:
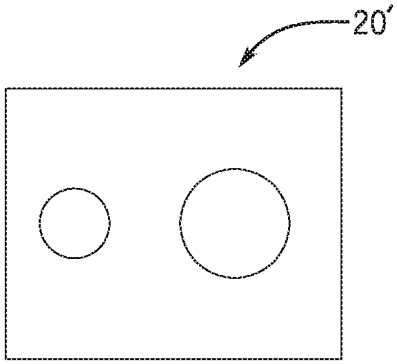
Figure 48C:
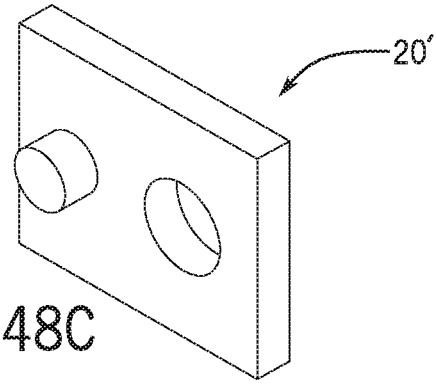
Figure 48D:
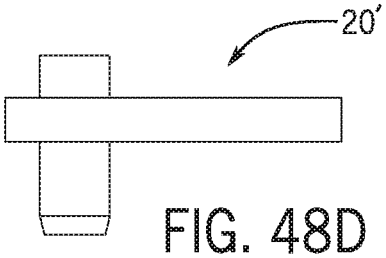
Figure 49A:
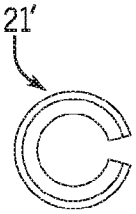
FIGS. 49A-49C illustrate an example handle push rod retainer pin 21' of the tool of FIG. 27.
Figure 49B:
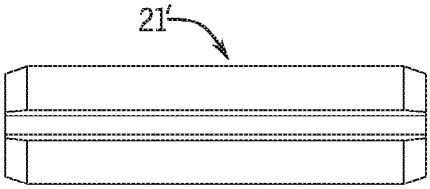
Figure 49C:
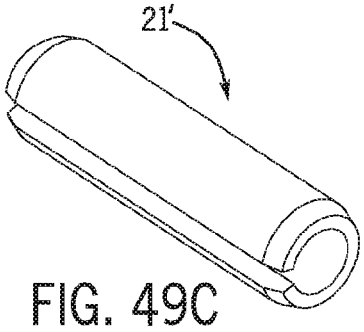

In FIG. 28, the blade spacer 20' is hidden by the blade 12' and the push rod retainer pin 21' is hidden by the contact pusher 8' and the push rod 19'

Figure 50:
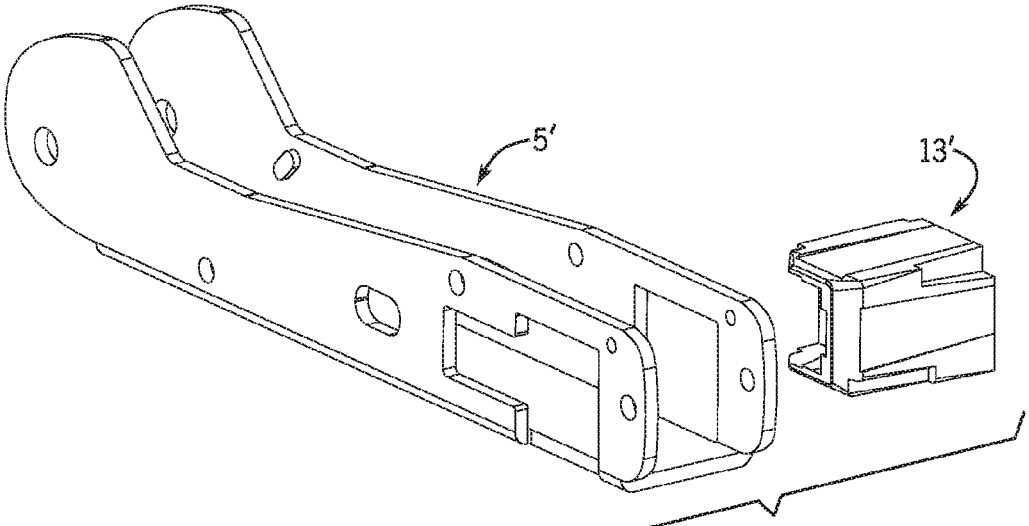
FIGS. 50-62 together illustrate an example of the modular plug nest assembly process
Figure 51:
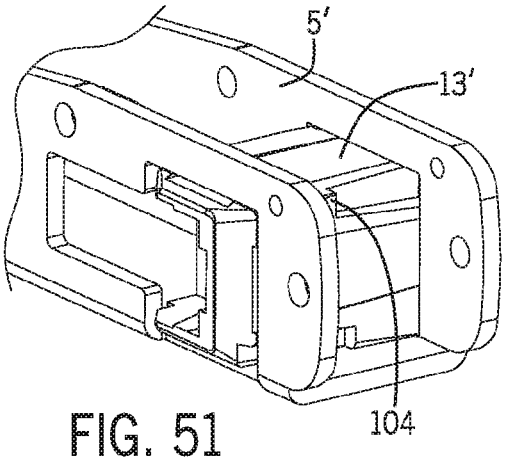
Figure 52:
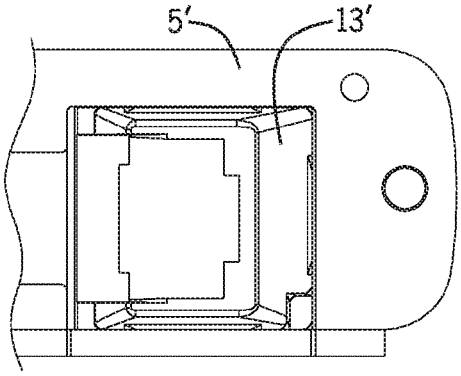
Figure 53:
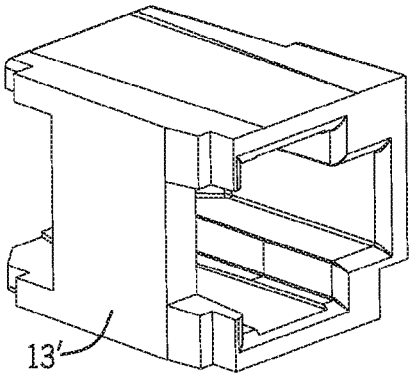
Figure 54:
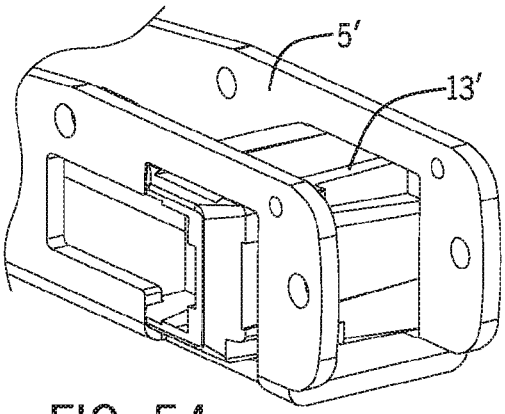
Figure 55:
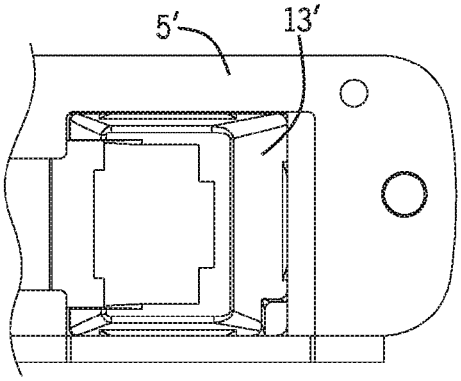
Figure 56:
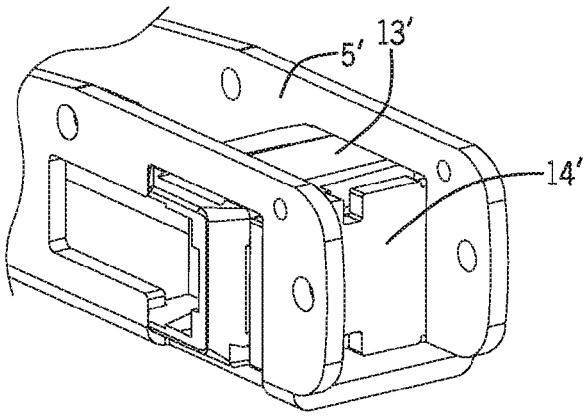
Figure 57:
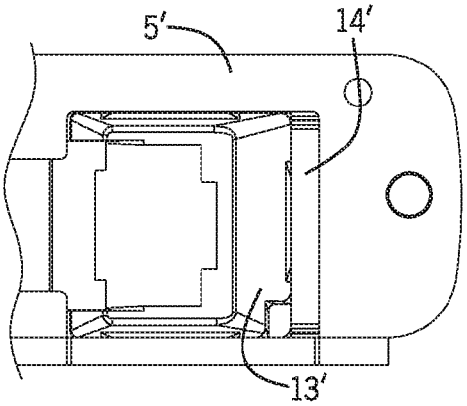

Referring to FIGS. 50-62, an example assembly process is shown. In this example, as shown in FIG. 50, the modular plug nest 13' is aligned to slide through the body 5' side wall slots. In FIG. 51, the modular plug nest 13' slides through the body 5' side wall slots until the modular plug nest 13' external mate surfaces align with the inside surfaces of the body 5'. In FIG. 52, the modular plug nest 13' slides toward the left (as shown in view) until the stop surfaces on the modular plug nest 13' mate with the opposing surfaces on the body 5'. In FIG. 53, the back plate 14' is inserted in the gap between the modular plug nest 13' and the side wall slots in the body 5'. The modular plug nest 13' includes a plurality of stop notches 104 that correspond to similar tabs 104' in the end cap 15'. Once installed, the end cap 15' and the tabs 104' engage the notches 104 and prevent the plug nest 13' from moving laterally.

Figure 58:
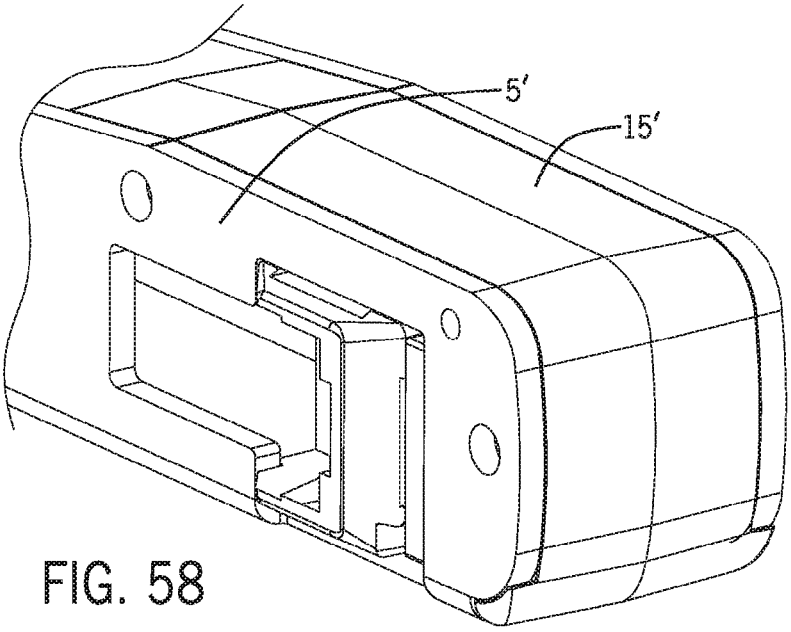
Figure 59:
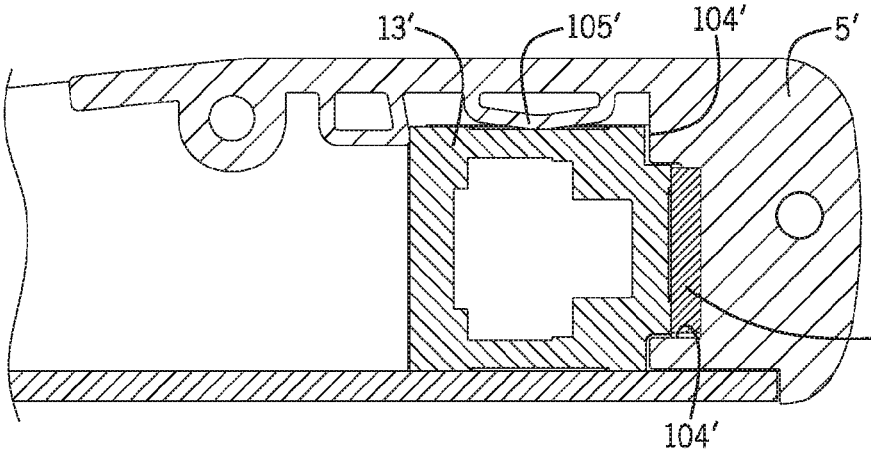
Figure 60:
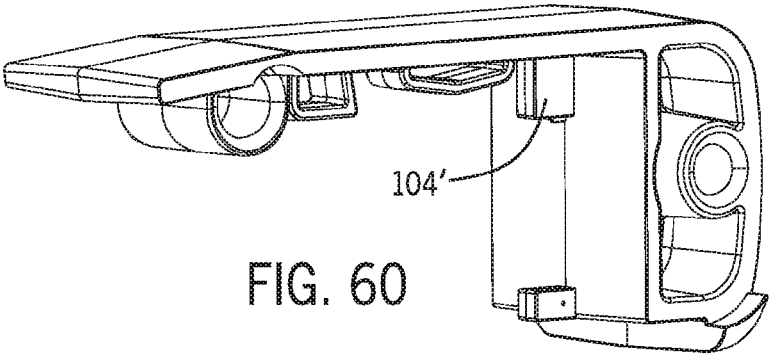
Figure 61:
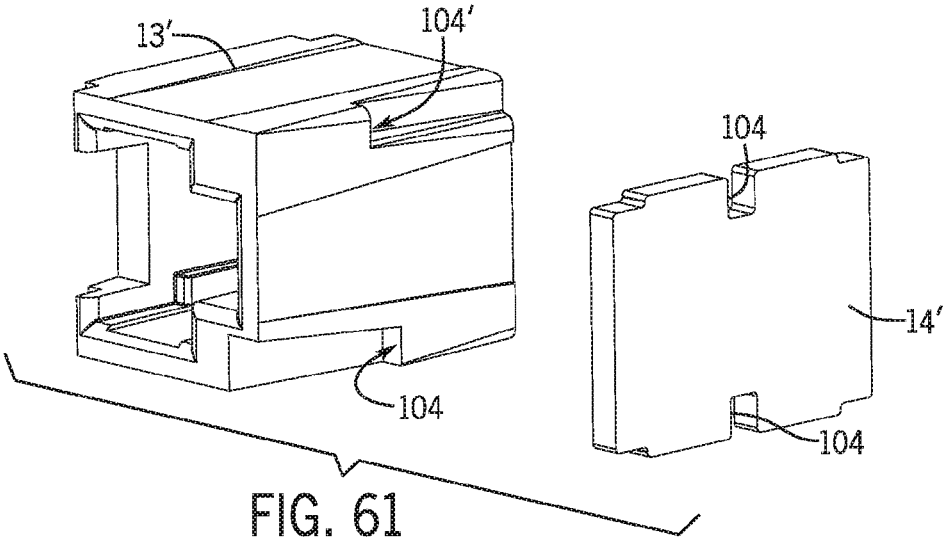
Figure 62:
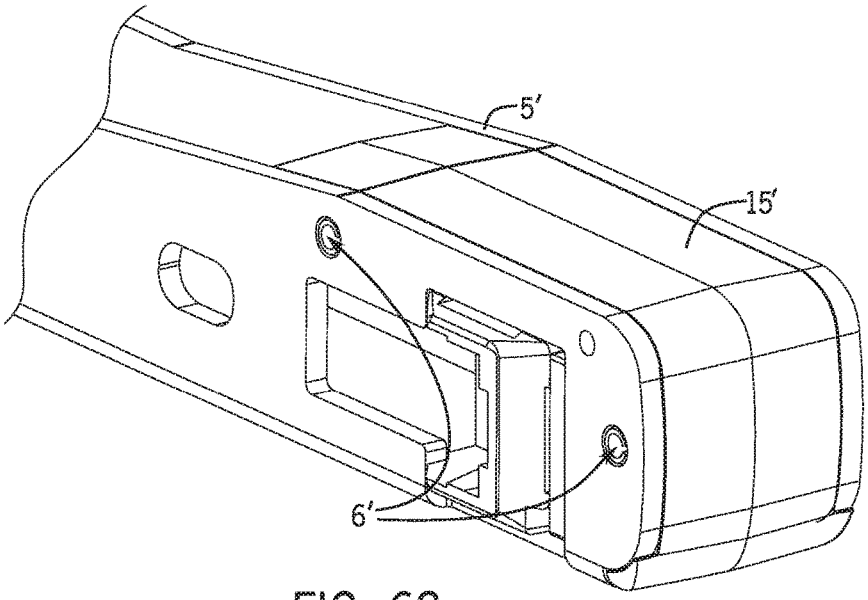

In FIGS. 58-59, the end cap 15' is assembled. The end cap 15' accomplishes at least three tasks with one part: it retains the back plate 14' and the modular plug nest 13'; it applies forces to the modular plug nest 13' to keep it from being loose in the tool; and it has aesthetic value by covering internal components. Finally, in FIG. 62, the roll pins 6' are inserted to retain the end cap 15'.

While specific examples of the features of the subject invention have been described in detail, it will be appreciated by those skilled in the art that various modifications and alternatives to those details could be developed in light of the overall teachings of this disclosure. It will therefore be appreciated that features described with respect to the various embodiments are not to be limited to any particular example but may be freely used across examples where applicable. Additionally, it will be appreciated that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures and components have not been described in detail as not to unnecessarily obscure aspects of the present invention.

All directional references (e.g., plus, minus, upper, lower, upward, downward, left, right, leftward, rightward, top, bottom, above, below, vertical, horizontal, clockwise, and counterclockwise) of the present disclosure are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

What is claimed is:

1. A crimping tool for an electrical connector, comprising:

a frame defining an interior;

a handle rotatably coupled with the frame;

a receptacle element disposed within the interior of the frame, the receptacle element being formed with an internally located cavity that is sized and shaped to receive an electrical connector and a plurality of exteriorly located stop notches;

an end cap removably mounted to the frame, the end cap comprising a plurality of tabs such that, when the end cap is mounted to the frame, the plurality of tabs of the end cap will engage with and cooperate with the plurality of stop notches of the receptacle element to prevent relative movement between the receptacle element disposed within the interior of the frame and the frame; and a push member, coupled with the handle, configured to apply a compressive force to an electrical connector disposed within the cavity of the receptacle element responsive to actuation of the handle relative to the frame.

2. The crimping tool of claim 1 further comprising a blade, coupled to a one of the frame, the receptacle element, or the push member, configured to cut excess wiring from an electrical connector disposed within the cavity of the receptacle element responsive to actuation of the handle relative to the frame.

3. The crimping tool of claim 1, further comprising a blade, rigidly coupled to the push member, configured to cut excess wiring from an electrical connector disposed within the cavity of the receptacle element as the push member applies a compressive force to the electrical connector.

4. The crimping tool of claim 1, further comprising a push rod, coupled to the handle and to the push member, configured to translate rotational movement of the handle relative to the frame into a linear force on the push member.

5. The crimping tool of claim 4, wherein the push rod and the push member have complementary apertures, the crimping tool further comprising a push rod pin disposed within the complementary apertures so as to couple the push rod with the push member.

6. The crimping tool of claim 5, wherein the frame includes a guide opening, the push rod pin disposed within the guide opening.

7. The crimping tool of claim 1, wherein the push member is a first push member configured to apply a compressive force to a first portion of an electrical connector disposed within the cavity of the receptacle element, the crimping tool further comprising a second push member coupled with the handle and configured to apply a compressive force to the electrical connector responsive to actuation of the handle relative to the frame.

8. The crimping tool of claim 1, wherein the frame and the end cap each comprise at least one lateral bore and wherein a roll pin is inserted into the lateral bore of the frame and the end cap to releasably retain the end cap in the frame.

* * * * *